US009394851B2

(12) United States Patent
Steiner et al.

(10) Patent No.: US 9,394,851 B2
(45) Date of Patent: Jul. 19, 2016

(54) STIRLING CYCLE TRANSDUCER FOR CONVERTING BETWEEN THERMAL ENERGY AND MECHANICAL ENERGY

(75) Inventors: Thomas Walter Steiner, Burnaby (CA); Briac Medard de Chardon, Vancouver (CA); Takao Kanemaru, Port Coquitlam (CA)

(73) Assignee: Etalim Inc., Burnaby, BC (CA)

( * ) Notice: Subject to any disclaimer, the term of this patent is extended or adjusted under 35 U.S.C. 154(b) by 929 days.

(21) Appl. No.: 13/382,245

(22) PCT Filed: Jul. 12, 2010

(86) PCT No.: PCT/CA2010/001092

§ 371 (c)(1),
(2), (4) Date: Mar. 9, 2012

(87) PCT Pub. No.: WO2011/003207

PCT Pub. Date: Jan. 13, 2011

(65) Prior Publication Data

US 2012/0159943 A1 Jun. 28, 2012

Related U.S. Application Data

(60) Provisional application No. 61/213,760, filed on Jul. 10, 2009.

(51) Int. Cl.

| | |
|---|---|
| ***F02G 1/04*** | (2006.01) |
| ***F02G 1/043*** | (2006.01) |
| ***F02G 1/053*** | (2006.01) |

(52) U.S. Cl.

CPC ..... *F02G 1/043* (2013.01); *F02G 1/053* (2013.01); *F02G 2243/52* (2013.01)

(58) Field of Classification Search

CPC ..... F02G 1/043; F02G 1/0435; F02G 1/053; F02G 1/057; F02G 2243/52; F02G 2275/40; F02G 2244/50; F03G 7/002

USPC ..... 60/516–540

See application file for complete search history.

(56) References Cited

U.S. PATENT DOCUMENTS

| | | | |
|---|---|---|---|
| 3,548,589 | A | 12/1970 | Cooke-Yarborough |
| 3,802,196 | A | 4/1974 | Franklin |

(Continued)

FOREIGN PATENT DOCUMENTS

| | | |
|---|---|---|
| DE | 3931312 | 3/1991 |
| EP | 0996848 B1 | 4/1998 |

(Continued)

OTHER PUBLICATIONS

Chinese Office Action, w/ English translation thereof, issued in Chinese Patent Application No. CN 201080031089.8 dated Mar. 4, 2014.

(Continued)

*Primary Examiner* — Thomas Denion
*Assistant Examiner* — Kelsey Stanek
(74) *Attorney, Agent, or Firm* — McDermott Will & Emery LLP

(57) ABSTRACT

The apparatus includes a housing, a compression chamber disposed in the housing and having at least a first interface operable to vary a volume of the compression chamber, an expansion chamber disposed in the housing and having a second interface operable to vary a volume of at least the expansion chamber, and a thermal regenerator in fluid communication with each of the compression chamber and the expansion chamber. The thermal regenerator is operable to alternatively receive thermal energy from gas flowing in a first direction through the regenerator and to deliver the thermal energy to gas flowing in a direction opposite to the first direction through the regenerator. The compression chamber, the expansion chamber, and the regenerator together define a working volume for containing a pressurized working gas. Each of the first and second interfaces are configured for reciprocating motion in a direction aligned with a transducer axis, the reciprocating motion being operable to cause a periodic exchange of working gas between the expansion and the compression chambers. In one aspect, at least one of the first and second interfaces includes a resilient diaphragm, and a cylindrical tube spring coupled between the diaphragm and the housing, the tube spring being configured to elastically deform in a direction generally aligned with the transducer axis in response to forces imparted on the tube spring by the diaphragm to cause the at least one of the first and second interfaces to have a desired natural frequency. In another aspect the apparatus includes a first heat exchanger in communication with the expansion chamber, a second heat exchanger in communication with the compression chamber, the thermal regenerator is disposed between the first and second heat exchangers, and each of the first and second heat exchangers are peripherally disposed within the housing with respect to the transducer axis and configured to receive working gas flowing to or from the respective chambers and to redirect the working gas flow through the regenerator.

30 Claims, 10 Drawing Sheets

(56) References Cited

U.S. PATENT DOCUMENTS

| | | | | |
|---|---|---|---|---|
| 3,805,527 | A | 4/1974 | Cooke-Yarborough et al. | |
| 4,004,421 | A | 1/1977 | Cowans | |
| 4,020,896 | A | 5/1977 | Mold et al. | |
| RE29,518 | E | 1/1978 | Franklin | |
| 4,077,216 | A | 3/1978 | Cooke-Yarborough | |
| 4,078,975 | A | 3/1978 | Spears, Jr. | |
| 4,078,976 | A | 3/1978 | Spears, Jr. | |
| 4,114,380 | A | 9/1978 | Ceperly | |
| 4,164,848 | A | 8/1979 | Gilli et al. | |
| 4,276,747 | A | 7/1981 | Faldella et al. | |
| 4,341,113 | A * | 7/1982 | Gutzwiller, Jr. | 73/105 |
| 4,345,437 | A * | 8/1982 | Dineen | 60/521 |
| 4,350,012 | A | 9/1982 | Folsom et al. | |
| 4,355,517 | A | 10/1982 | Ceperly | |
| 4,359,872 | A | 11/1982 | Goldowsky | |
| 4,361,008 | A * | 11/1982 | Dineen | 60/521 |
| 4,377,400 | A | 3/1983 | Okamoto et al. | |
| 4,380,152 | A | 4/1983 | Folsom et al. | |
| 4,387,567 | A | 6/1983 | White | |
| 4,398,398 | A | 8/1983 | Wheatley et al. | |
| 4,416,114 | A | 11/1983 | Martini | |
| 4,418,533 | A | 12/1983 | Folsom | |
| 4,423,599 | A | 1/1984 | Veale | |
| 4,434,617 | A | 3/1984 | Walsh | |
| 4,474,233 | A | 10/1984 | Swozil | |
| 4,484,938 | A | 11/1984 | Okamoto et al. | |
| 4,489,553 | A | 12/1984 | Wheatley et al. | |
| 4,603,731 | A | 8/1986 | Olsen | |
| 4,607,424 | A | 8/1986 | Johnson | |
| 4,623,808 | A | 11/1986 | Beale et al. | |
| 4,766,013 | A | 8/1988 | Warren | |
| 4,832,118 | A | 5/1989 | Scanlon et al. | |
| 5,042,565 | A | 8/1991 | Yuen et al. | |
| 5,170,144 | A | 12/1992 | Nielsen | |
| 5,180,459 | A | 1/1993 | Bauer et al. | |
| 5,224,030 | A | 6/1993 | Banks et al. | |
| 5,281,479 | A | 1/1994 | Rittner et al. | |
| 5,301,506 | A | 4/1994 | Pettingill | |
| 5,316,080 | A | 5/1994 | Banks et al. | |
| 5,329,768 | A | 7/1994 | Moscrip | |
| 5,389,695 | A | 2/1995 | Jaster et al. | |
| 5,389,844 | A | 2/1995 | Yarr et al. | |
| 5,457,956 | A | 10/1995 | Bowman et al. | |
| 5,628,363 | A | 5/1997 | Dewar et al. | |
| 5,655,600 | A | 8/1997 | Dewar et al. | |
| 5,749,226 | A | 5/1998 | Bowman et al. | |
| 5,845,399 | A | 12/1998 | Dewar et al. | |
| 5,896,895 | A | 4/1999 | Simpkin | |
| 5,941,079 | A * | 8/1999 | Bowman et al. | 62/6 |
| 5,962,348 | A | 10/1999 | Bootle et al. | |
| 6,021,648 | A | 2/2000 | Zonneveld et al. | |
| 6,032,464 | A | 3/2000 | Swift et al. | |
| 6,041,598 | A | 3/2000 | Bliesner | |
| 6,263,671 | B1 | 7/2001 | Bliesner | |
| 6,314,740 | B1 | 11/2001 | De Blok et al. | |
| 6,516,617 | B1 | 2/2003 | Schwieger | |
| 6,526,750 | B2 | 3/2003 | Bliesner et al. | |
| 6,578,364 | B2 | 6/2003 | Corey | |
| 6,659,172 | B1 | 12/2003 | Dewar et al. | |
| 6,673,328 | B1 | 1/2004 | Klett et al. | |
| 6,701,711 | B1 | 3/2004 | Litwin | |
| 6,796,123 | B2 | 9/2004 | Lasker | |
| 6,862,883 | B2 | 3/2005 | Kamen et al. | |
| 6,913,075 | B1 | 7/2005 | Knowles et al. | |
| 6,914,025 | B2 | 7/2005 | Ekstrom et al. | |
| 6,959,753 | B1 | 11/2005 | Weber et al. | |
| 6,966,182 | B2 | 11/2005 | Kamen et al. | |
| 6,978,611 | B1 | 12/2005 | Landis | |
| 7,007,469 | B2 | 3/2006 | Bliesner | |
| 7,013,964 | B2 | 3/2006 | Pays et al. | |
| 7,051,529 | B2 | 5/2006 | Murphy et al. | |
| 7,081,699 | B2 | 7/2006 | Keolian et al. | |
| 7,104,073 | B2 | 9/2006 | Chen et al. | |
| 7,132,161 | B2 | 11/2006 | Knowles et al. | |
| 7,156,217 | B2 * | 1/2007 | Raber | 192/84.6 |
| 7,284,709 | B2 | 10/2007 | Guyer | |
| 7,299,633 | B2 | 11/2007 | Murphy et al. | |
| 7,306,823 | B2 | 12/2007 | Sager et al. | |
| 7,325,401 | B1 | 2/2008 | Kesseli et al. | |
| 2002/0053422 | A1 | 5/2002 | Juslenius et al. | |
| 2003/0188856 | A1 | 10/2003 | Pays et al. | |
| 2003/0211376 | A1 | 11/2003 | Hatoh et al. | |
| 2005/0016171 | A1 | 1/2005 | Fellows | |
| 2008/0047546 | A1 | 2/2008 | Cummings | |

FOREIGN PATENT DOCUMENTS

| | | | |
|---|---|---|---|
| EP | 1116872 | A1 | 1/2001 |
| GB | 2298903 | | 9/1996 |
| JP | 05-005479 | A | 1/1993 |
| JP | 2005-002919 | A | 1/2005 |
| WO | WO9713956 | | 4/1997 |
| WO | WO 99/51069 | A2 | 10/1999 |
| WO | WO 99/51069 | A3 | 10/1999 |
| WO | WO 2005/013398 | A2 | 2/2005 |
| WO | WO 2005/013398 | A3 | 2/2005 |
| WO | WO 2008/022406 | A1 | 2/2008 |
| WO | WO 2008/022407 | A1 | 2/2008 |

OTHER PUBLICATIONS

Japanese Decision to Grant issued in Japanese Patent Application No. JP 2012-518715 dated Mar. 4, 2014.

Meneroud, P.; Magnac, G.; Patient, F.; Claeyssen, F.; Bistable Micro Actuator for Energy Saving; Actuator 2006; P76; pp. 744-747; Jun. 14-Jun. 16, 2006; Bremen, Germany.

Knowles, T.R.; Composite Matrix Regenerator for Stirling Engines; National Aeronautics and Space Administration (NASA); Jan. 1997; Lewis Research Center, Cleveland, OH.

Flynn Research Inc.; Parallel Path Magnetic Technology for High Efficiency Power Generators and Motor Drives; undated document; Flynn Research, Greenwood, MO.

International Search Report from corresponding PCT Application No. PCT/CA2010/001092.

European Search Report dated Mar. 9, 2015 from corresponding European Application No. 10796639.2.

* cited by examiner

STIRLING CYCLE TRANSDUCER FOR CONVERTING BETWEEN THERMAL ENERGY AND MECHANICAL ENERGY

RELATED APPLICATIONS

This application is a 371 US National Phase of International Application No. PCT/CA2010/001092, filed Jul. 12, 2010 and claims the benefit of U.S. Application No. 61/213,760, filed Jul. 10, 2009. The entire teachings of the above applications are incorporated herein by reference.

BACKGROUND OF THE INVENTION

1. Field of Invention

This invention relates generally to transducers and more particularly to a Stirling cycle transducer for converting thermal energy into mechanical energy or for converting mechanical energy into thermal energy.

2. Description of Related Art

Stirling cycle heat engines and heat pumps date back to 1816 and have been produced in many different configurations. Potential advantages of such Stirling cycle devices include high efficiency and high reliability. The adoption of Stirling engines has been hampered in part by the cost of high temperature materials, and the difficulty of making high pressure and high temperature reciprocating or rotating gas seals. Furthermore the need for relatively large heat exchangers and low specific power in comparison to internal combustion engines has also hampered widespread adoption of Stirling engines. Specific power refers to output power per unit of mass, volume or area and low specific power results in higher material costs for the engine for a given output power.

Thermoacoustic heat engines are a more recent development, where the inertia of the working gas cannot be ignored as is often done in Stirling engine analysis. In a thermoacoustic engine designs, the inertia of the gas should be accounted for and may dictate the use of a tuned resonator tube in the engine. Unfortunately at reasonable operating frequencies the wavelength of sound waves is however too long to allow for compact engines and consequently results in relatively low specific power. Thermoacoustic engines are however mechanically simpler than conventional Stirling engines and do not require sliding or rotating high-pressure seals.

One promising variant of the Stirling engine is a diaphragm engine in which flexure of a diaphragm replaces the sliding pistons in conventional Stirling engines thus reducing friction and wear. Several diaphragm engines have been proposed and built, but generally have low specific power (i.e. the power produced per unit volume is low). There remains a general need for improved heat engines and heat pumps, and more specifically for improved diaphragm heat engines and heat pumps.

SUMMARY OF THE INVENTION

In accordance with one aspect of the invention there is provided a Stirling cycle transducer apparatus for converting between thermal energy and mechanical energy. The apparatus includes a housing, a compression chamber disposed in the housing and having at least a first interface operable to vary a volume of the compression chamber, an expansion chamber disposed in the housing and having a second interface operable to vary a volume of at least the expansion chamber, and a thermal regenerator in fluid communication with each of the compression chamber and the expansion chamber. The thermal regenerator is operable to alternatively receive thermal energy from gas flowing in a first direction through the regenerator and to deliver the thermal energy to gas flowing in a direction opposite to the first direction through the regenerator. The compression chamber, the expansion chamber, and the regenerator together define a working volume for containing a pressurized working gas. Each of the first and second interfaces are configured for reciprocating motion in a direction aligned with a transducer axis, the reciprocating motion being operable to cause a periodic exchange of working gas between the expansion and the compression chambers. At least one of the first and second interfaces includes a resilient diaphragm, and a cylindrical tube spring coupled between the diaphragm and the housing, the tube spring being configured to elastically deform in a direction generally aligned with the transducer axis in response to forces imparted on the tube spring by the diaphragm to cause the at least one of the first and second interfaces to have a desired natural frequency.

Each of the first and second interfaces may include a resilient diaphragm.

Each of the first and second interfaces may be configured for reciprocating motion at a natural frequency of at least about 250 Hz.

The pressurized working gas may have a static pressure of at least about 3 MPa.

The first interface may include a resilient diaphragm and the second interface may include a displacer disposed between the expansion chamber and the compression chamber and the reciprocating motion of the second interface may be operable to vary the volume of both the expansion chamber and the compression chamber.

The apparatus may include a mount for mounting the transducer apparatus, the mount being operably configured to permit reciprocating complementary vibration of the apparatus in the direction of the transducer axis to impart a reciprocating motion to the displacer at the desired phase angle.

The expansion chamber may be defined between a first surface of the displacer and a wall of the housing and the first surface of the displacer may include a flexure configured to permit reciprocating motion of the displacer, and a central portion of the wall may be offset along the transducer axis from the displacer with respect to a peripheral portion of the wall for accommodating the reciprocating motion of the displacer.

The compression chamber may be defined between a second surface of the displacer and the diaphragm and the second surface of the displacer may include a flexure configured to permit reciprocating motion of the displacer, and the central portion of the diaphragm may be offset along the transducer axis with respect to a peripheral portion of the diaphragm for accommodating reciprocating motion of the displacer.

The displacer may include a flexure, the flexure including a peripheral portion, a central portion, and an intermediate flexing portion extending between the peripheral portion and the central portion, the flexing portion configured such that during reciprocating motion of the displacer, flexing occurs substantially in the intermediate flexing portion.

The intermediate flexing portion of the flexure may have an increased thickness proximate the central portion and tapers to a reduced thickness distal to the central portion.

The peripheral portion, the intermediate flexing portion, and the central portion may together define a thickness profile for the flexure, and the thickness profile may be selected to cause the flexure to have an effective area to cause reciprocating motion of the displacer to be out of phase with the reciprocating motion of the first interface by a desired phase angle, the effective area being less than a physical area of the flexure due to deformation of the flexure during reciprocating motion.

The thickness profile of the flexure may be selected to cause the flexure to have an effective area to impart reciprocating motion to the displacer at the desired phase angle in absence of reciprocating complementary vibration of the apparatus.

The flexure may include a first flexure operable to vary a volume of the expansion chamber and the displacer may further include a second flexure operable to vary a volume of the compression chamber, the first and second flexures being spaced apart and configured for corresponding reciprocating motion and the second flexure may include a peripheral portion, a central portion, and an intermediate flexing portion extending between the peripheral portion and the central portion, the intermediate flexing portion being configured such that during reciprocating motion, flexing occurs substantially in the intermediate flexing portion.

The intermediate flexing portion of at least one of the first and second flexures may have an increased thickness proximate the central portion and tapers to a reduced thickness distal to the central portion.

The apparatus may include an insulating material disposed between the first and second flexures, the insulating material being operable to provide thermal insulation between the expansion chamber and the compression chamber.

The first and second flexures define an insulating volume therebetween, the insulating volume being operable to receive an insulating gas having a lower thermal conductivity than the working gas.

The insulating gas may include a gas selected from the group consisting of argon, krypton, and xenon.

The peripheral portion, the intermediate flexing portion, and the central portion may together define a thickness profile for the second flexure, and the thickness profile of at least one of the first and second flexures may be selected to cause the flexure to have an effective area to cause reciprocating motion of the displacer to be out of phase with the reciprocating motion of the first interface by a desired phase angle, the effective area being less than a physical area of the first and second flexures due to deformation of the flexures during reciprocating motion.

At least one of the first flexure and the second flexure may further include an additional flexure extending at least between the peripheral portion and the central portion, the additional flexure disposed between the first and second flexures and being operable to increase a stiffness associated with the at least one of the first and second flexures.

The apparatus may include a support extending between the first flexure and the second flexure, the support being operable to couple the first and second flexures.

The support may include a plurality of supports.

The support may include an annular rib.

The support may be disposed in at least one of the central portion of the respective first and second flexures and the intermediate flexing portion of the respective first and second flexures.

The first and second flexures each may include a material capable in operation of infinite fatigue life.

The apparatus may include an electro-mechanical transducer coupled to the displacer, the electro-mechanical transducer being configured for one of coupling mechanical energy to the displacer to cause the periodic exchange of the working gas between the expansion and the compression chambers, and coupling mechanical energy from the displacer to dampen reciprocating motion of the displacer.

The tube spring may include at least a portion disposed to contain the pressurized working gas.

The tube spring may be configured to provide sufficient stiffness in a direction aligned with the transducer axis to cause the at least one of the first and second interfaces to have a natural frequency of at least about 250 Hz.

The tube spring may include an outer cylindrical wall having first and second ends, the first end being coupled to the housing, and an inner cylindrical wall coaxially disposed within the outer cylindrical wall and coupled between the second end of the outer cylindrical wall and the diaphragm.

The working gas may bear on a first surface of the diaphragm and the tube spring may be coupled between a second surface of the diaphragm and the housing to define a bounce chamber between the second surface of the diaphragm, the housing, and the tube spring, the bounce chamber being operable to contain a gas volume bearing on the second surface of the diaphragm.

The tube spring may include a bore and may further include a rod mechanically coupled to the diaphragm and extending outwardly within the bore of the tube spring, the rod being operable to facilitate coupling of the transducer to an electro-mechanical transducer.

The apparatus may include a strain gauge disposed on a wall of the tube spring, the strain gauge being operably configured to produce a time varying strain signal representing an instantaneous strain in the wall of the tube spring during reciprocating motion, the time-varying strain being proportional to an amplitude of the reciprocating motion of the diaphragm and an average value of the time varying strain signal being further proportional to an average static working gas pressure.

The diaphragm may include a material capable in operation of infinite fatigue life and the diaphragm may have a thickness profile across the diaphragm that may be selected to cause stress concentrations across the diaphragm to be reduced below a fatigue threshold limit for the material.

The diaphragm may include a peripheral portion, a central portion having a thickness that may be greater than a thickness of the peripheral portion, and a transition portion extending between the peripheral portion and the central portion, the transition portion having a generally increasing thickness between the peripheral portion and the central portion.

The working gas may bear on a first surface of the diaphragm and the apparatus may further include a bounce chamber for containing a pressurized gas volume bearing on a second surface of the diaphragm.

A volume of the bounce chamber may be selected to be sufficiently larger than a swept volume swept by the diaphragm during the reciprocating motion such that pressure oscillations in the bounce chamber are reduced thereby reducing hysteresis losses associated with the gas volume in the bounce chamber.

The apparatus may include an equalization conduit for facilitating gaseous communication between the working gas in the expansion and compression chambers and the gas volume in the bounce chamber, the equalization conduit being sized to permit static pressure equalization between the working gas and the gas volume within the bounce chamber while being sufficiently narrow to prevent significant gaseous communication during time periods corresponding to an operating frequency of the transducer apparatus.

The expansion chamber may be configured to receive thermal energy from an external source for increasing a temperature of the working gas within the expansion chamber and the reciprocating motion of at least one of the first and second interfaces may alternately cause the increased temperature working gas in the expansion chamber to pass through the regenerator, thereby reducing a temperature of the working gas flowing into the compression chamber, and cause the reduced temperature working gas in the compression chamber to pass through the regenerator, thereby increasing a temperature of the working gas flowing into the expansion chamber. The reciprocating motion of at least one of the first and second interfaces facilitates expansion of the working gas when an average temperature of the working gas is increased and compression of the working gas when the average temperature of the working gas is reduced.

At least one of the first and second interfaces may include an electro-mechanical transducer coupled to the interface, the electro-mechanical transducer being operably configured to receive mechanical energy from the interface and to convert the mechanical energy into electrical energy.

At least one of the first and second interfaces may include an electro-mechanical transducer coupled to the interface for imparting the reciprocating motion to the interface and the reciprocating motion of at least one of the first and second interfaces may alternately causes the working gas in the compression chamber to pass through the regenerator, thereby reducing a temperature of the working gas flowing into the expansion chamber, and cause the working gas in the expansion chamber to pass through the regenerator, thereby increasing a temperature of the working gas flowing into the compression chamber. The reciprocating motion of at least one of the first and second interfaces facilitates compression of the working gas when an average temperature of the working gas is increased and expansion of the working gas when the average temperature of the working gas is reduced thereby causing the expansion chamber to be cooled relative to the compression chamber.

In accordance with another aspect of the invention there is provided a Stirling cycle transducer apparatus for converting between thermal energy and mechanical energy. The apparatus includes a housing, a compression chamber disposed in the housing and having at least a first interface operable to vary a volume of the compression chamber, and an expansion chamber disposed in the housing and having a second interface operable to vary a volume of at least the expansion chamber. The apparatus also includes a first heat exchanger in communication with the expansion chamber, a second heat exchanger in communication with the compression chamber, and a thermal regenerator disposed between the first and second heat exchangers and being operable to alternatively receive thermal energy from gas flowing in a first direction through the regenerator and to deliver the thermal energy to gas flowing in a direction opposite to the first direction through the regenerator. The expansion chamber, the first heat exchanger, the regenerator, the second heat exchanger, and the compression chamber together define a working volume for containing the working gas. Each of the first and second interfaces are configured for reciprocating motion in a direction aligned with a transducer axis, the reciprocating motion being operable to cause a periodic exchange of working gas between the expansion and the compression chambers. Each of the first and second heat exchangers are peripherally disposed within the housing with respect to the transducer axis and configured to receive working gas flowing to or from the respective chambers and to redirect the working gas flow through the regenerator.

Each of the first and second heat exchangers may have a greater transverse extent than height and may be configured to cause gaseous flow in a generally transverse direction through the heat exchangers.

Each of the first and second heat exchangers may include a substantially transversely extending interface in communication with the regenerator and redirection of the working gas flow occurs proximate the interface.

Each of the expansion and compression chambers may have a transverse extent significantly greater than a height of the respective chambers such that a portion of the volume that may be swept during reciprocating motion is increased as a proportion of the volume containing the working gas.

The apparatus may include a heat transport conduit disposed in thermal communication with at least one of the first and second heat exchangers, the heat transport conduit being configured to carry a heat exchange fluid for transporting heat between an external environment and the at least one of the first and second heat exchangers.

The expansion chamber may be separated from the compression chamber by an insulating wall dimensioned to provide sufficient thermal insulation to reduce heat conduction between the expansion chamber and the compression chamber, and may further include at least one access conduit for directing working gas between at least one of the expansion chamber and the first heat exchanger, and the compression chamber and the second heat exchanger.

In accordance with another aspect of the invention there is provided a hot wall apparatus for use in a Stirling cycle transducer for converting between thermal energy and mechanical energy, the transducer including a housing including an expansion chamber, a compression chamber, and a thermal regenerator together defining a volume for containing a pressurized working gas. The hot wall apparatus includes a high thermal conductivity wall, and a low thermal conductivity insulating spacer extending between the wall and the housing.

The high thermal conductivity wall may include at least one of a ceramic material including silicon carbide, a ceramic material including aluminum nitride, a ceramic material including silicon nitride (Si3N4), a material including sapphire, a refractory metal, a refractory metal including tungsten, and a carbon-carbon composite material.

The high thermal conductivity wall may include a first silicon carbide material composition having a high thermal conductivity and the low thermal conductivity insulating spacer may include a second silicon carbide material composition having a low thermal conductivity.

The high thermal conductivity wall may include a material having a first thermal expansion rate and the insulating spacer may include a material having a second thermal expansion rate, and the materials may be selected to provide a sufficiently close match between thermal expansion rates to reduce mechanical stresses at an interface between the wall and the spacer when operating at high temperature.

The high thermal conductivity wall may include a material that may have greater strength in compression than in tension and the wall may be fabricated in a dome-shape such that in operation the wall is primarily subjected to compressive stresses.

The low thermal conductivity insulating spacer may include at least one of a material including fused silica, a ceramic material including zirconia, a ceramic material including mullite, a ceramic material including alumina, and a ceramic material including sialon.

The low thermal conductivity insulating spacer may include at least one of a silicon carbide ceramic having low thermal conductivity, a silicon nitride (Si3N4) ceramic having low thermal conductivity, and an aluminum nitride ceramic having low thermal conductivity.

The high conductivity wall and the low thermal conductivity insulating spacer each may include a carbon-carbon composite having high conductivity carbon fibers oriented in a radial direction to simultaneously provide high radial conductivity and low transverse conductivity.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DETAILED DESCRIPTION

Introduction

The output power of a Stirling engine $W_{out}$ empirically follows the formula:

$$W_{out} = N_W \cdot P_m \cdot f \cdot V_s \frac{T_h - T_c}{T_h + T_c}, \quad \text{Eqn 1}$$

where

- $N_W$ is the "West" number ("Principles and Applications of Stirling Engines", Colin D. West, Van Nostrand Reinhold, 1986);
- $P_m$, is the mean working-gas pressure;
- f is the operating frequency;
- $T_h$, $T_c$, are the respective hot and cold side temperatures; and
- $V_s$ is the volume swept by the power piston.

In a diaphragm engine, the diaphragm is usually fabricated from a metal such as steel, which restricts a maximum operating deflection of the diaphragm thus placing a constraint on the swept volume $V_S$ in Eqn 1. The swept volume constraint may be compensated for by operating at increased frequency, increased temperature differential, and/or increased pressure in order to provide a greater power output for a particular engine. The West number $N_W$ accounts for losses and an engine design that minimizes losses will have a greater West number. The West number for a range of prior art engines was found to average about $N_W$=0.25.

The temperature differential term in Eqn 1 may be increased by increasing the hot side temperature $T_h$. The maximum theoretical efficiency of any heat engine operating between a heat reservoir at a hot temperature $T_h$ and a colder heat reservoir at temperature $T_c$ is the Carnot efficiency:

$$\eta_C = \frac{T_h - T_c}{T_h} \quad \text{Eqn 2}$$

Heat engines will generally operate at only a fraction of this maximum theoretical efficiency. Raising the hot side temperature is a conceptually simple method of improving engine specific power and efficiency without any other detrimental side effects on the gas cycle. However limitations of conventionally used materials in Stirling engines constrain the maximum practical hot side temperature. Increased pressure further complicates material selection since the materials will then have to handle both increased temperature and pressure. Conventional engine design has generally employed stainless steel or nickel alloys resulting in maximum hot side temperatures of approximately 800° C.

Operating at higher frequencies and/or working gas pressure would appear to increase $W_{out}$ in accordance with Eqn 1, but increased losses under these operating conditions may reduce the West number $N_W$, thereby offsetting gains. For example, flow friction power dissipation increases with working gas velocity and thus increases with increasing frequency. At higher frequencies and pressures traditional Stirling engine analysis does not adequately represent engine operation as the working gas inertia becomes increasingly important and thus it is necessary to apply thermoacoustic analysis to accurately model operation of an engine.

Structural Overview

Figure 1:
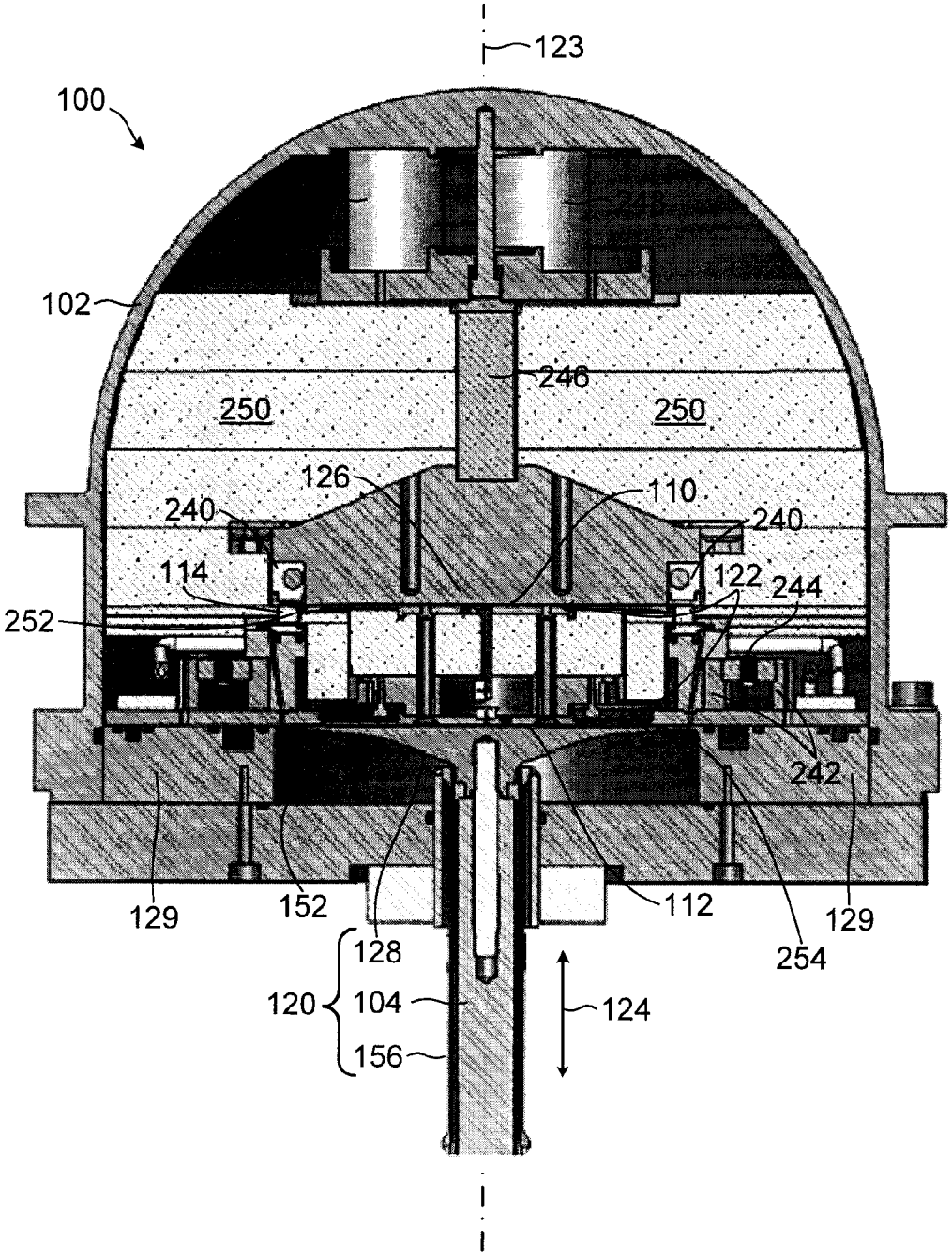
FIG. 1 is a cross-sectional view of a Stirling cycle transducer apparatus according to a first embodiment of the invention.

Referring to FIG. 1, a Stirling cycle transducer apparatus according to a first embodiment of the invention is shown generally at 100. The apparatus 100 includes a housing 102 and a rod 104 protruding from the housing. The apparatus includes a compression chamber 112 disposed in the housing 102 and having at least a first interface 120 operable to vary a volume of the compression chamber. The apparatus 100 also includes an expansion chamber 110 disposed in the housing 102 and having a second interface 122 operable to vary a volume of at least the expansion chamber. In the embodiment shown a vertical extent or height of the expansion and compression chambers 110 and 112 may be only about 200 μm. Accordingly, the expansion and compression chambers 110 and 112 are not clearly visible in FIG. 1 due to the scale of the drawing.

The apparatus 100 further includes a thermal regenerator 114 in fluid communication with each of the compression chamber 112 and the expansion chamber 114.

The compression chamber 112, the expansion chamber 110, and the regenerator 114 together define a working volume for containing a pressurized working gas. Each of the first and second interfaces 120 and 122 are configured for reciprocating motion in a direction aligned with a transducer axis 123, the reciprocating motion being operable to cause a periodic exchange of working gas between the expansion and the compression chambers. The thermal regenerator 114 is operable to alternatively receive thermal energy from gas flowing in a first direction through the regenerator and to deliver the thermal energy to gas flowing in a direction opposite to the first direction through the regenerator.

At least one of the first and second interfaces 120 and 122 includes a resilient diaphragm. In the embodiment shown in FIG. 1 the first interface 120 includes a resilient diaphragm 128 extending between supports 129. The apparatus also includes a cylindrical tube spring 156 coupled between the diaphragm 128 and the housing 102. The tube spring 156 is configured to elastically deform in a direction generally aligned with the transducer axis 123 in response to forces imparted on the tube spring by the diaphragm 128 to cause the first interface 120 to have a desired natural frequency.

In general, the Stirling transducer apparatus 100 will operate in any orientation. Any references to "top" or "bottom" herein is only a reference to the specific orientation depicted in the drawings and does not have any operational significance.

The Stirling cycle transducer apparatus 100 shown in FIG. 1 is generally referred to as a "beta" configuration having a generally rigid top wall 126. In other embodiments, the second interface 122 may form a top wall of the expansion chamber and may be configured as a resilient diaphragm similar to the diaphragm 128. Such a Stirling cycle transducer embodiment is generally referred to as an "alpha" configuration.

In the embodiment shown in FIG. 1, the first interface 120 includes the rod 104, which is mechanically coupled to the diaphragm 128. The rod 104 facilitates either providing a mechanical reciprocating drive to the diaphragm 128 for operation of the apparatus 100 as a heat pump. Alternatively, when the apparatus 100 is operated as an engine, the rod 104 may be coupled to a driven load, such as an electro-mechanical transducer operably configured to convert the mechanical energy into electrical energy, for example.

Figure 2:
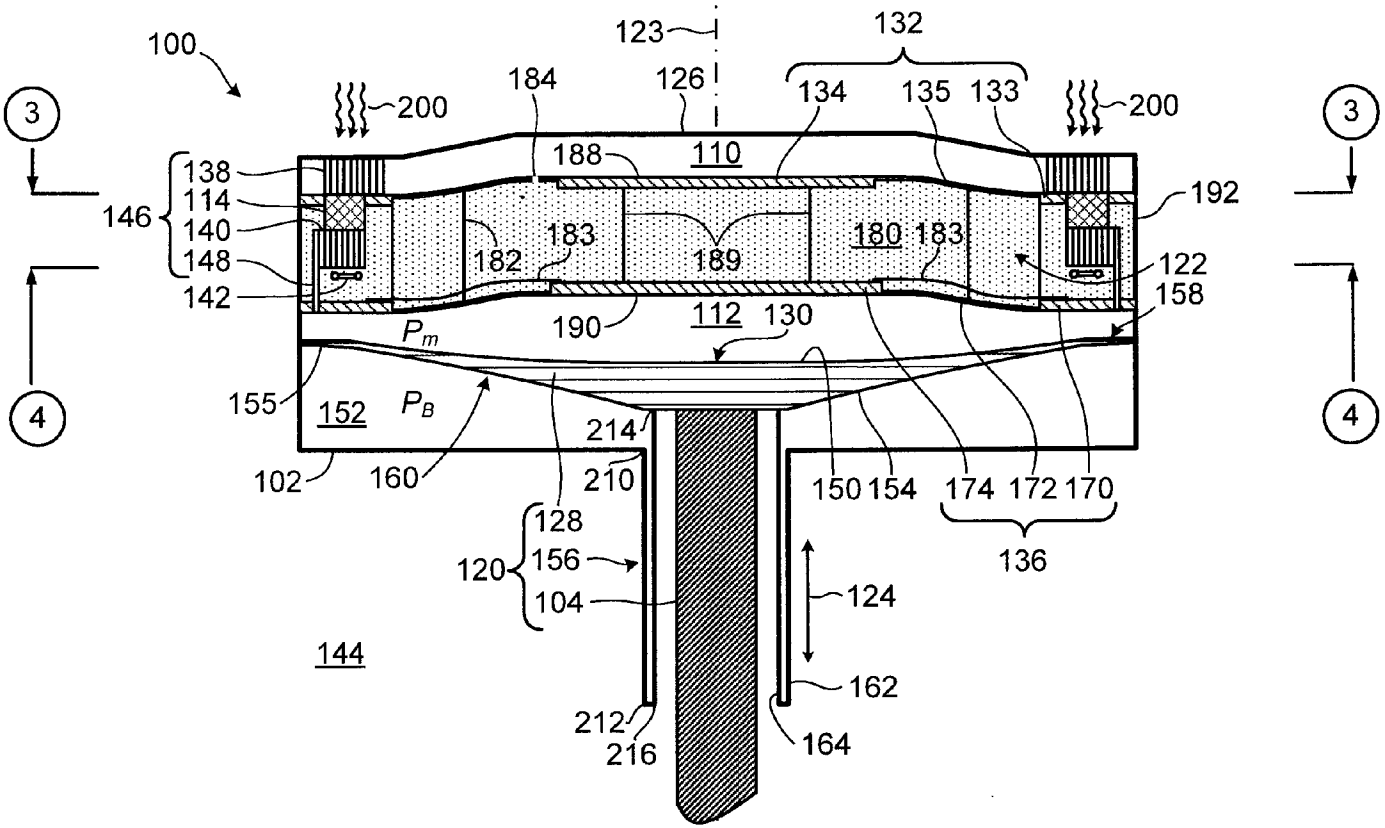
FIG. 2 is a front cross-sectional schematic view of the Stirling cycle transducer apparatus shown in FIG. 1.

The apparatus 100 is shown schematically in FIG. 2, in which a vertical extent of each of the chambers 110 and 112 has been increased for purposes of illustrating certain features of the invention. A vertical extent of the first interface 120, the second interface 122, and the respective deflections of these interfaces has also been exaggerated in FIG. 2. However it should be understood that FIG. 2 has been included only for purposes of illustrating certain features of the invention while the apparatus 100 shown in FIG. 1, is better representative of the relative dimensions of the various elements of the apparatus.

Referring to FIG. 2, in the embodiment shown the second interface 122 includes a first resilient flexure 132, having a peripheral portion 133, a central portion 134, and an intermediate flexing portion 135 extending between the support portion and the central portion. The second interface 122 also includes a second resilient flexure 136 having a peripheral portion 170, a central portion 174, and an intermediate flexing portion 172 extending between the support portion and the central portion. In the embodiment shown, the central portions 134 and 174 and the peripheral portions 133 and 170 are thicker than the respective intermediate flexing portions 135 and 172 such that flexing of the flexures 132 and 136 will predominantly occur in the respective intermediate flexing portions. The increased thickness of the central portions 134 and 174 and the peripheral portions 133 and 170 minimize any flexing in these respective regions during the reciprocating movement of the second interface.

In one embodiment (not shown), the flexing portion 135 may have increased thickness in a region proximate the central portion 134 and a thickness profile of the flexure 132 may taper to a reduced thickness away from the central portion, such that flexing predominantly occurs distally with respect to the central portion. The central portion 134 may be generally thicker that the flexing portion 135 to reduce flexing of the central portion during reciprocating motion.

The second interface 122 also includes supports 189 connecting the central portion 134 of the first flexure 132 and the central portion 174 of the second flexure 136 for movement together. In this embodiment the second interface 122 further includes supports 182 connecting between the flexing portions 135 and 172 of the first and second flexures 132 and 136. The supports 182 and 189 may be implemented as an annular cylindrical support or may be implemented as a plurality of posts. The second interface 122 further includes an insulating material 180, such as a porous ceramic or fibrous material. The insulating material 180 takes up space between the first and second flexures 132 and 136 that is not occupied by the supports 182, 189, and other elements such as the regenerator 114.

Figure 3:
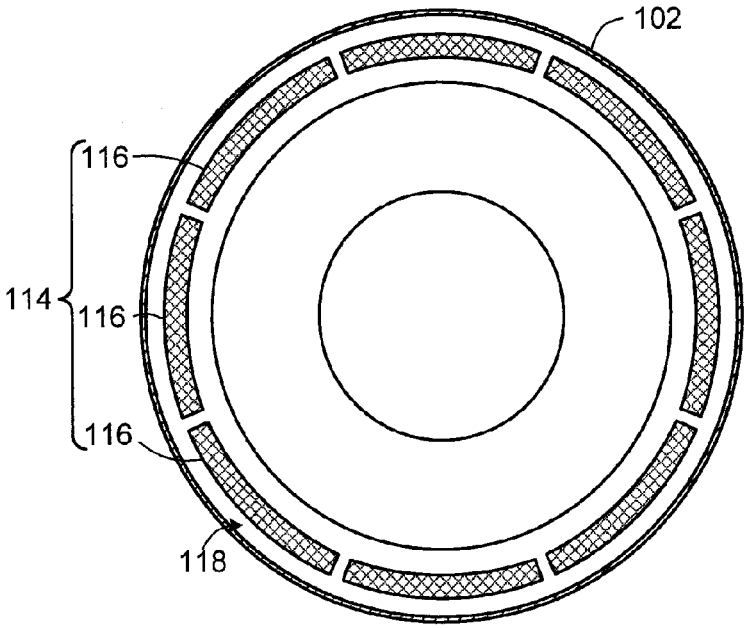
FIG. 3 is a cross-sectional schematic view of the Stirling cycle transducer apparatus shown in FIG. 2.

The apparatus 100 is shown in top cross-sectional view in FIG. 3. Referring to FIG. 3, in the embodiment shown the regenerator 114 comprises a plurality of regenerator segments 116 arranged around a periphery 118 of expansion and compression chambers 110 and 112.

Referring back to FIG. 2, in the embodiment shown the apparatus 100 further includes a first heat exchanger 138 in communication with the expansion chamber 110 and a second heat exchanger 140 in communication with the compression chamber 112. The regenerator 114 is disposed between the first and second heat exchangers. The first heat exchanger 138, the regenerator 114, and the second heat exchanger 140 together form a gas passage 146 extending between the expansion chamber 110 and the compression chamber 112. The passage 146 may further include an access conduit portion 148 in communication with the compression chamber 112. The access conduit portion is operable to direct gas flow between the second heat exchanger 140 and the compression chamber 112.

The apparatus 100 also includes a heat transport conduit 142 in thermal communication with the second heat exchanger 140 for carrying a heat exchange fluid for transporting heat between an external environment 144 and the second heat exchanger (in FIG. 4 two of the heat transport conduits 142 are shown in partially cut-away view to reveal the heat exchanger 140 below).

Figure 4:
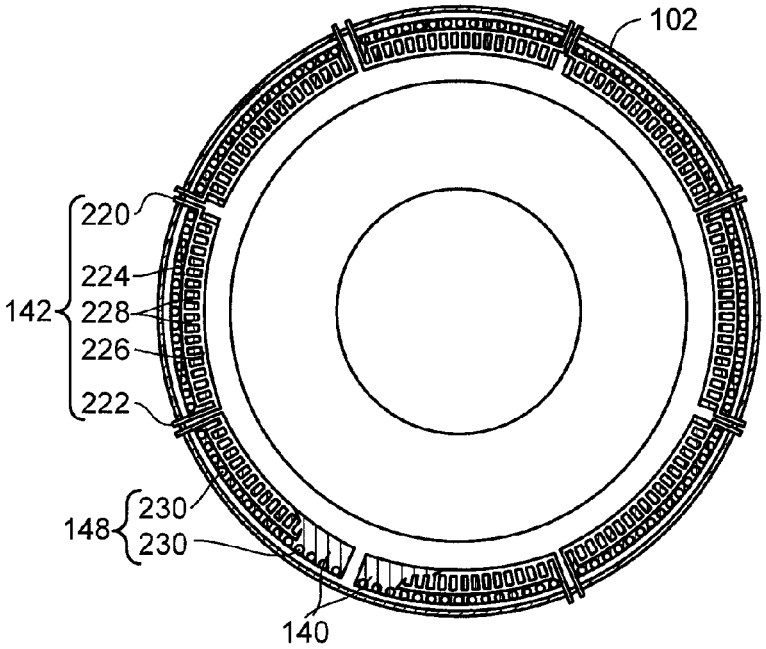
FIG. 4 is a further cross-sectional schematic view of the Stirling cycle transducer apparatus shown in FIG. 2.

Referring to FIG. 4, the heat transport conduit 142, access conduit portion 148, and the second heat exchanger 140 each comprise a plurality of segments (shown in cross sectional view in FIG. 4) corresponding generally to the regenerator segments 116 shown in FIG. 3. In the embodiment shown the heat transport conduit 142 includes a fluid inlet 220 and a fluid outlet 222. The fluid inlet 220 is in communication with an inlet manifold 224 and the outlet 222 is in communication with an outlet manifold 226. The heat transport conduit 142 also includes a plurality of passages 228 extending between the inlet manifold 224 and the outlet manifold 226. The passages 228 are in thermal communication with the second heat exchanger 140 an inlet manifold 224 and an outlet manifold 226 for respectively receiving colder and discharging hotter heat transport fluid. The access conduit portion 148 includes a plurality of access tubes 230 extending between the compression chamber 112 and the second heat exchanger 140.

In operation, the apparatus 100 is charged to a pressure $P_m$ with a working gas such as helium or hydrogen, which occupies the expansion chamber 110, the compression chamber 112, and the passage 146. The static charge pressure of the working gas may be about 3 MPa or greater. The working gas pressure bears on a first surface 150 of the diaphragm 128, which due to the compliance of the diaphragm would cause an outwardly directed deformation of the diaphragm. However, in the embodiment shown the apparatus 100 further includes a bounce chamber 152 for containing a pressurized gas volume bearing on a second surface 154 of the diaphragm. The gas in the bounce chamber is charged to a pressure $P_B \approx P_m$ to at least partially equalize forces on the first and second respective surfaces 150 and 154 of the diaphragm. The bounce chamber 152 has walls defined by the housing 102 and the diaphragm 128, and is sealed by a tube spring 156 extending between the second surface 154 of the diaphragm and the housing 102.

In one embodiment a deliberate leak may be introduced between the bounce chamber 152 and the compression chamber 112 in the form of a narrow equalization conduit 155 such as a ruby pinhole. The equalization conduit 155 facilitates gaseous communication between the working gas in the expansion chamber 110 and compression chambers 112 and the gas volume in the bounce chamber 152. The equalization conduit 155 is sized to permit static pressure equalization between the working gas and the gas volume while being sufficiently narrow to prevent significant gaseous communication at time periods corresponding to an operating frequency of the transducer apparatus.

The tube spring 156 further provides a restorative force to the diaphragm 128 during reciprocating motion. The tube spring 156, the diaphragm 128, and the rod 104 together form the first interface 120, which in FIG. 2 is shown in an undeflected or equilibrium position.

Referring back to FIG. 1, in the embodiment shown, the apparatus 100 is configured as a beta Stirling engine having a hot side shown generally at 252 and a cold side shown generally at 254. The housing 102 is configured as a pressure vessel to contain the working gas at high pressure example >3 MPa). The top wall 126 held in place by an insulating post 246, which is urged downwardly by a pair of springs 248 acting between the housing 102 and the post 246. A space between the housing 102 and the engine components is filled with an insulating material 250 to reduce heat losses from the hot side 252 of the apparatus 100.

Operation

The conceptual operation of the apparatus 100 as a Stirling engine is described with reference to FIGS. 5-9. When configured as a Beta Stirling engine, the second interface 122 is located between the expansion chamber 110 and the compression chamber 112 and acts as a displacer. For convenience and clarity, the term "displacer" will be used when referring to the second interface 122 of a Beta configuration Stirling engine.

In general, a Stirling engine receives thermal energy from an external source 200, which heats the working gas in the expansion chamber causing an average gas temperature to increase. The engine works by compressing the working gas while the average working gas temperature is generally lower and expanding the working gas while the working gas temperature is generally higher. Compressing a colder working gas requires less work than the energy provided through expansion of the hotter working gas and the difference between these energies provides a net mechanical energy output.

Figure 5:
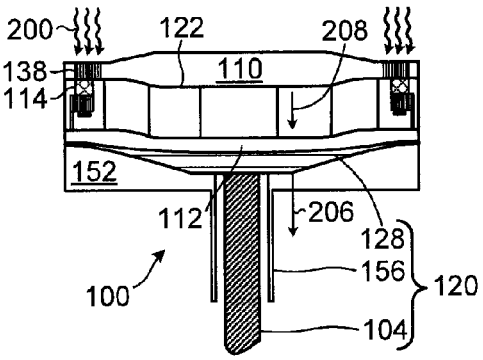
FIG. 5 to FIG. 8 are a series of front cross sectional schematic views depicting operation of the Stirling cycle transducer apparatus shown in FIG. 2.

Referring to FIG. 5, when operating as an engine, the first heat exchanger 138 receives thermal energy 200 provided from an external heat source and raises a temperature of the working gas flowing through the first heat exchanger. The required changes in working gas average temperature are provided by periodic exchange of the working gas between the expansion and the compression chambers 110 and 112, which in this embodiment is caused by the reciprocating motion of the displacer 122.

Figure 8:
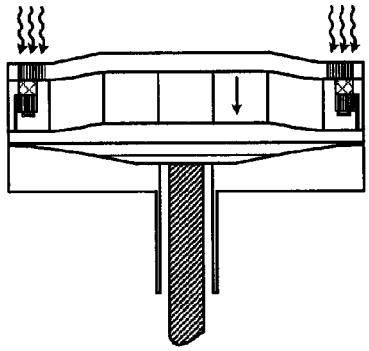
Figure 9:
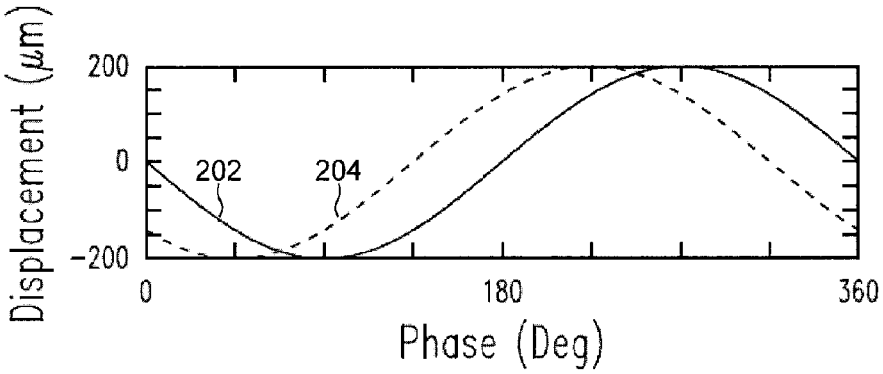
FIG. 9 is a graphical depiction of respective locations of a diaphragm and a displacer of the Stirling cycle transducer apparatus as shown in FIG. 5 to FIG. 8.

Referring to FIG. 9, respective locations of the diaphragm 128 and the displacer 122 for a full 360° operating cycle of the engine are graphically depicted at 202 and 204 respectively. The first interface motion is plotted as a series of displacement locations at 202 and the displacer motion is plotted as a series of displacement locations at 204. The drawing FIGS. 5-9 represent successive instantaneous locations of the diaphragm 128 and the displacer 122 at 0°, 90°, 180°, and 270° respectively. In this embodiment the displacer reciprocating motion 204 leads the reciprocating motion 202 of the first interface 120 by 45°.

Referring to FIG. 5, the diaphragm 128 is shown at its center location, which is arbitrarily designated as the 0° state, and the first interface 120 is moving downwardly (as shown by the arrow 206). The displacer 122 is also moving downwardly (as shown by the arrow 208) and is nearing the bottom of its downward stroke. A greater proportion of the working gas is located in the expansion chamber 110, having been heated while passing through the regenerator 114 and the first heat exchanger 138. Heating the gas increases an instantaneous pressure P and drives the diaphragm 128 downwardly. This is the power output stroke of the engine, where work is done by the expanding working gas. A portion of the work goes into working against the resilience of the diaphragm 128, compression of the tube spring 156, and compression of and the volume of gas in the bounce chamber 152 thus storing energy. A remaining portion of the work is available at the rod 104 as output power.

Figure 6:
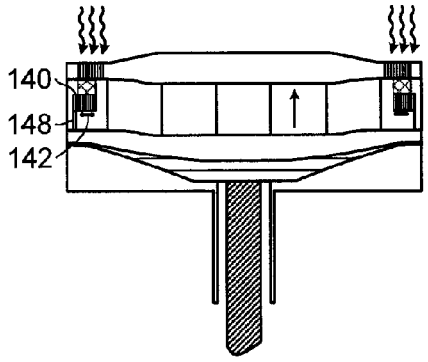

Referring now to FIG. 6, which represents the engine state at 90°, the first interface 120 is at the bottom of its stroke while the displacer 122 has reversed direction and started moving upwardly. At this time, the upward displacer motion forces gas from the expansion chamber 110. The gas passes through the hot heat exchanger, and through the regenerator 114, which extracts heat from the hot gas for storage within the regenerator. The gas then passes through the second heat exchanger 140. The second heat exchanger 140 is in thermal communication with the heat transport conduit 142, which in this embodiment carries a cooling fluid, such as water. The second heat exchanger 140 cools the gas, which then passes through the access conduit portion 148 into the compression chamber 112. The working gas portion in the compression chamber thus has a colder average temperature than the gas in the expansion chamber. As the displacer 122 continues to move upwards a greater proportion of the working gas is forced into the compression chamber 112, thus decreasing the average temperature of the working gas.

Figure 7:
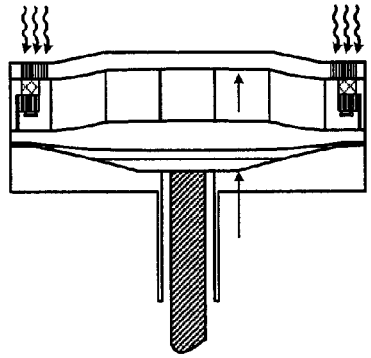

Referring to FIG. 7, which represents the engine state at 180°, the diaphragm 128 is again at its center position, moving upwardly and compressing the working gas while the displacer 122 is nearing the top of its stroke. Work is done on the working gas as it is compressed, and the energy for the compression is provided by stored energy in the diaphragm 128, tube spring 156, and the compressed gas volume in the bounce chamber 152. In some embodiments it may be desirable to minimize the restorative forces due to the gas volume in the bounce chamber 152, such that restorative forces provided by the tube spring 156 dominate. The restorative forces provided by the bounce chamber 152 are associated with hysteresis losses and reliance on dominant restorative forces being provided by the tube spring 156 avoids such hysteresis losses. The restorative force provided by the bounce chamber 152 may be reduced by making a volume of the bounce chamber sufficiently large in comparison to a volume swept by the second surface 154 of the diaphragm 128. Since compression of the cold working gas requires less energy than is available from the expansion of the hot working gas, the engine provides useful output power at the rod 104.

Referring to FIG. 8, which represents the engine state at 270°, the first interface 120 is at the top of its stroke and the displacer 122 has reversed direction and started moving downwardly forcing gas out of the compression chamber 112 through the second heat exchanger 140, and through the regenerator 114. In the regenerator 114, at least a portion of the stored heat (i.e. the heat extracted from the hot gas during the operation stage depicted in FIG. 5) is transferred back to the gas. Further heating of the working gas occurs while flowing through the first heat exchanger 138 into the expansion chamber 110. The average temperature of the working gas thus rises as hot gas is forced into the expansion chamber 110. A portion of the Stirling engine cycle of FIG. 6 and FIG. 7 represent what is termed a hot to cold blow of the Stirling engine, while FIG. 8 and FIG. 5 represent what is termed a cold to hot blow of the Stirling engine.

The cycle then repeats through FIG. 5 to FIG. 8. While only 4 instantaneous states have been shown in FIG. 5-FIG. 8, it should be understood that the state changes continuously, as indicated by sinusoidal motion 202 and 204 of the first interface 120 and displacer 122 in FIG. 9.

Energy may be extracted from the engine in the form of mechanical work at the rod 104 and through heating of the heat exchange fluid within the heat transport conduit 142. The heat exchange fluid in the heat transport conduit 142 is heated during operation of the engine and this heat may be extracted for secondary heating purposes, for example. The temperature increase of the heat exchange fluid depends on a heat capacity and a flow rate of the heat exchange fluid. For example, a temperature rise of about 10° C. is likely for a high heat capacity heat exchange fluid such as water. A temperature of the second heat exchanger 140 would generally be at about the same temperature as the heat exchange fluid. The second heat exchanger 140 should be kept as cold as possible for best engine efficiency, and thus maintaining a low temperature of the heat exchange fluid is beneficial to engine operating efficiency. However, in some embodiments where it is desired to utilize the heat from the heat exchange fluid for a specific purpose, the engine may be operated or configured to produce a desired temperature rise for the specific use in the heat exchange fluid.

The thermal energy 200 is continuously provided to the working gas predominantly in the first heat exchanger 138 and rejected predominantly in the second heat exchanger 140 in order to maintain a temperature difference between the working gas in the expansion chamber 110 and the compression chamber 112. As long as the thermal energy 200 is provided and rejected, reciprocating motion of the first interface 120 and displacer 122 is self sustaining. Advantageously, the heat exchangers 138 and 140 have a large surface area in thermal communication with the working gas in order to limit a required temperature difference between the heat exchanger surfaces and the working gas for transfer of heat. However the surface area of the heat exchangers 138 and 140 should not be so large as to substantially impede flow of gas through the respective heat exchangers.

Referring back to FIG. 2, a surface 188 of the first flexure 132 of the first interface 122 has a first physical area and a first effective area and, a surface 190 of the second flexure 136 has a second physical area and second effective area. The effective areas are defined in terms of a physical area of an analogous fixed piston displacer. Since the flexures 132 and 136 deform with displacement, the respective effective areas are less than the respective physical areas. If the first and second effective areas of the surfaces 188 and 190 are equal then the reciprocating motion of the displacer 122 does not vary the working gas volume. In the absence of flow friction, gas inertia, and temperature difference, the reciprocating motion of the displacer 122 would then not produce any pressure oscillation in the working gas. However, given a temperature difference between the expansion and compression chambers 110 and 112, the reciprocating motion of the displacer 122 produces a pressure oscillation that depends on the volume ratio of hot to cold gas, which varies with the reciprocating motion of the displacer. The resulting pressure swings in both the expansion and compression chamber volumes would then be in-phase with each other and either in-phase or 180° out of phase with the motion of the displacer 122, depending on the motion sign convention and on the sign of the temperature difference. The reciprocating motion of the displacer 122 changes the expansion and compression chamber volumes and thus causes gas to flow through the passage 146 in order to reduce the pressure imbalance between the chambers. A real gas has some viscosity and thus a driving pressure difference between the respective volumes of working gas in the expansion chamber 110 and the compression chamber 112 is required in order to drive this gas flow. This pressure difference, which is in phase with the volume flow rate of the gas produces a loss in the regenerator 114, which acts as a primary flow restriction. The working gas inertia is also important at high frequency and pressure but is not accounted for in traditional Stirling engine analysis. To change the direction of the gas flow 304 twice per cycle requires acceleration of the working gas mass. For a given displacement of any volumetric portion of the working gas, the required acceleration increases as the square of the operating frequency. A pressure difference between the volumes of gas in the expansion chamber 110 and the compression chamber 112 is required to provide this acceleration. This pressure difference is in quadrature with the volume flow rate of the gas and does not produce additional losses. It does however influence the resonant frequency of the displacer 122, as the pressure differences due to the inertia of the working gas mass acts as an additional effective mass associated with the displacer.

In one operational embodiment the displacer 122 provides a self initiated and self sustaining reciprocating motion by selectively balancing forces that act on the displacer surfaces 188 and 190, as described later herein. Even if first and second effective areas of the respective first and second surfaces 188 and 190 are equal, there is still a net force on the displacer 122 due to pressure swings in the expansion and compression chambers 110 and 112 not being exactly in phase due to gas viscosity and inertial effects.

The various components of the Stirling cycle transducer apparatus 100 when configured as a beta type Stirling engine as shown in FIG. 1 and FIG. 2 will now be described in greater detail.

Diaphragm

The diaphragm 128 may be fabricated from a metal such as steel, that when operated below a fatigue stress threshold exhibits infinite fatigue life. A maximum deflection of the diaphragm 128 is thus limited by the maximum infinite life fatigue stress or endurance limit of the material. The diaphragm 128, if made from the common low cost steel alloy such as 1040, will have an endurance limit stress of about 200 MPa. Endurance limit stress is about one-half of the tensile strength for steel alloys up to a maximum of about 700 MPa. Higher maximum stress is thus available using more expensive alloys. For example, using 17-4PH stainless steel should result in maximum allowable diaphragm stresses of about 500 MPa. Endurance limit stress declines with increasing temperature but Nickel super-alloys are available with maximum stress >300 MPa at 750 C. The diaphragm 128 is not operated at elevated temperature in the beta engine configuration of the embodiment shown in FIG. 2.

In FIG. 2, the diaphragm is shown at an equilibrium position, which occurs when there are no net forces acting on the diaphragm. In the equilibrium position, a central portion 130 of the first surface 150 of the diaphragm 128 is offset with respect to a peripheral portion 158 and has a shape that generally corresponds to the shape of the displacer 122 when displaced downwardly from its equilibrium position. In FIG. 2, a vertical scale of the offset and shape of diaphragm 128 has been exaggerated.

The offset and shape of the diaphragm 128 facilitates nesting of the motion of the diaphragm and displacer. In contrast, if the first surface 150 of the diaphragm 128 were to be flat when in the equilibrium position, a larger compression chamber volume would be required to facilitate the respective reciprocating motions of the diaphragm and displacer 122. Advantageously, the diaphragm 128 allows a chamber height proximate the housing 102 to be smaller than would otherwise be the case thereby reducing a volume of the chamber 112.

The diaphragm 128 has increased thickness in a centrally disposed portion of the diaphragm generally in the region of the central portion 130. The thicker central portion 130 reduces stresses that occur in the centrally disposed portion of the diaphragm during reciprocating motion. These stresses include gas pressure stresses causes by changing pressure conditions in the working volume. The gas pressure stresses add to bending stress in a central portion 130 of the diaphragm 128 and reduces stress in peripheral regions 158 of the diaphragm. In the embodiment shown, a thickness profile of the diaphragm 128 is adjusted to equalize the stresses in the central portion 130 and the peripheral regions 158. Since gas pressure stresses are dependent on an amplitude of the periodic pressure swing in the working volume during operation, the thickness profile of the diaphragm 128 would only equalize stresses when operating at or near a design pressure amplitude. In the embodiment shown in FIG. 1, the supports 129 and diaphragm 128 are integrally formed. To achieve a reasonable operating lifetime of the apparatus 100, the diaphragm 128 should be designed to reduce operating stresses in the diaphragm to below a fatigue threshold limit (i.e. to provide an infinite fatigue life). In this embodiment, the apparatus 100 is designed for a center displacement of about ±200 μm from the equilibrium position.

The central portion 130 of the diaphragm 128 has a greater thickness than the peripheral portion 158 and also includes a transition portion 160 extending between the peripheral portion 158 and the central portion 130. The transition portion 160 has a generally increasing thickness between the peripheral portion 158 and the central portion 130. The thicker central portion 130 results in a relatively rigid center portion that couples diaphragm force to the driving rod 104. The thickness profile of the transition portion 160 is selected such that stresses in this portion are below the fatigue threshold limit. The selected profile of the diaphragm 128 takes into account, not only displacement stresses but also gas pressure stresses induced by deflections of the diaphragm during reciprocating motion changing the working gas volume. The variation in thickness across the diaphragm 128 thus reduces a peak stress in the diaphragm for a given displacement to below the fatigue threshold limit for the material. In one embodiment, the thickness profile of the diaphragm 128 may be selected to even out the stress concentrations such that at maximum displacement the stresses at any point on the diaphragm are generally uniform. The thickness profile of the diaphragm 128 as shown advantageously results in a high diaphragm displacement consistently within the fatigue stress threshold for the diaphragm material.

Tube Spring and Bounce Chamber

Figure 18:
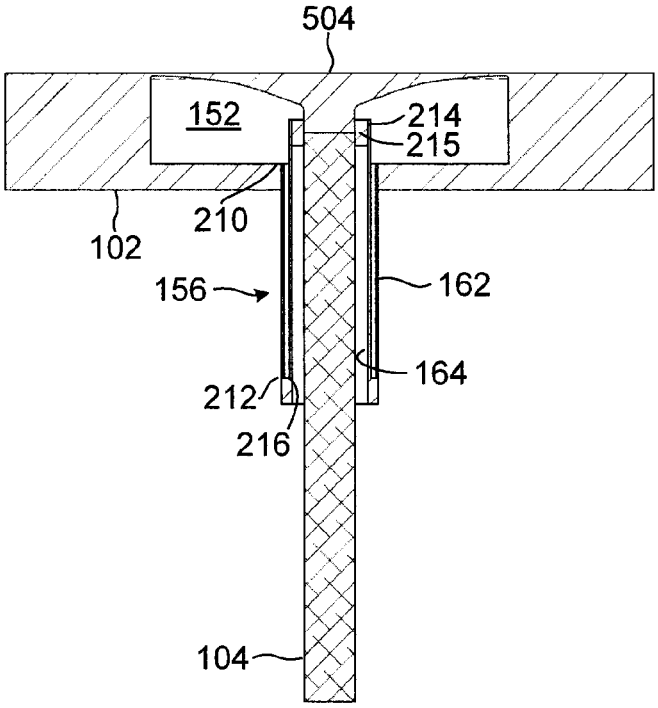
FIG. 18 is a cross sectional view of a tube spring shown in FIG. 1 and FIG. 2.

The tube spring 156 is shown in greater detail in FIG. 18. The tube spring 156 includes an outer cylindrical wall 162 having first and second ends 210 and 212 and an inner cylindrical wall 164 having third and fourth ends 214 and 216. The first end 210 of the outer cylindrical wall 162 is connected to the housing 102 and the third end 214 of the inner cylindrical wall 164 is rigidly coupled to the diaphragm 128 by an annular ring 215. The second end 212 of the outer cylindrical wall 162 and the fourth end 216 of the inner cylindrical wall 164 are connected together to cause the inner and outer cylindrical walls to each elastically deform in a direction generally aligned with the reciprocating motion 124. Advantageously, use of folded tubes having inner and outer walls 162 and 164 results in a tube spring having a shorter length. In other embodiments, the tube spring 156 may have more than a single fold. Advantageously, tube spring 156 also provides for convenient sealing of the bounce chamber 152. This allows for coupling of mechanical power from inside the housing 102 to outside the housing by means of the rod 104, without requiring a sliding gas seal.

Advantageously the folded back tube spring 156 as shown in FIG. 2 and FIG. 18 accommodates any changes in tube spring overall length due to temperature gradients along the length of the tube without causing significant displacement of the diaphragm or additional stress in the tube spring. Thermal expansions or contractions of the inner wall 164 and outer wall 162 will substantially cancel each other, leaving only a short thermally uncompensated length of the inner wall 164 between the housing 102 and the diaphragm 128.

In operation, the tube spring 156 undergoes compressive and extensive strain in the direction of the reciprocating motion 128. The inner wall 164 and outer wall 162 have strains of opposite sign (i.e. if the inner wall 164 is in compression, the outer wall 162 will be in tension). The length of a tube spring 156 determines stress in the walls 162 and 164 of the tube spring for a given deflection and a minimum combined length of the inner and outer walls may be calculated to reduce stress in the tubes below the fatigue threshold limit. A wall thickness and tube length determines the spring stiffness or spring constant k. The gas pressure $P_B$ in the bounce chamber 152, which bears on the tube spring 156, may also set a minimum wall thickness of the inner and outer walls 162 and 164.

Referring back to FIG. 2, the equalization conduit 155 causes the pressure in the bounce chamber 152 to equalize in pressure with the working gas pressure. However, appreciable pressure equalization on the time scale of the engine operating frequency is not permitted due to the narrow conduit dimension and accordingly, the instantaneous pressure in the bounce chamber 152 does not follow the working gas pressure swings during reciprocating motion of the diaphragm. However, the reciprocating motion of second surface 154 of the diaphragm 128 causes the bounce chamber to be subjected to a periodic change in volume corresponding to the swept volume of the diaphragm 128. If the volume of the bounce chamber 152 were comparable to the swept volume of the diaphragm, the bounce space would act as a gas spring and contribute to the overall mechanical stiffness of the first interface 120. In the embodiment shown in FIG. 1, the volume of the bounce chamber 152 is sufficiently larger than the swept volume, such that insignificant pressure oscillations occur in the bounce chamber thereby avoiding gas-spring hysteresis losses in the bounce chamber.

Since pressurized gas bears on both the first and second surfaces 150 and 154 of the diaphragm 128, the diaphragm need not be designed to withstand the full working gas pressure. Rather the diaphragm 128 is only required to withstand a differential pressure between the working gas volume and the volume of gas in the bounce chamber 152. However, due to the tube spring 156 and rod 104 coupled to the second surface 154, an area of the second surface that is exposed to the pressure $P_B$ is smaller than an area of the first surface 150 exposed to the working gas pressure $P_m$. Consequently, in this embodiment where the equalization conduit 155 equalizes the static pressures $P_B$ and $P_m$, there is a net downward force due to the imbalance. This net downward force causes a static downward deflection of the diaphragm 128 and produces a static longitudinal strain in the tube spring 156. This longitudinal strain is partially offset by a hoop stress induced longitudinal strain in an opposite direction. In general, a hoop stress is a circumferential stress in a cylindrically shaped structure as a result of internal or external pressure. In this case the tube spring 156 is subjected to the working gas pressure, which causes hoop stress in the tube spring walls 162 and 164. The hoop stress causes a corresponding hoop strain as well as a longitudinal strain, where a ratio of longitudinal strain to hoop strain may be calculated using Poisson's ratio, which is a material dependent property. For steel the Poisson's ratio is about −0.3.

The remaining deflection may be compensated by preloading the tube-spring to counteract this force such that in the un-deflected or equilibrium position, the tube spring urges the diaphragm upwardly to counteract the imbalance. A foil strain gauge (not shown) may be mounted on a wall of the tube-spring to provide a strain signal for adjusting this preload. Advantageously, during reciprocating motion the strain gauge produces a time varying strain signal representing an instantaneous strain in the tube spring during reciprocating motion of the diaphragm, which is proportional to an amplitude of the reciprocating motion of the diaphragm. Furthermore, an average or DC value of the time varying strain signal is proportional to an average static working gas pressure.

In alternative embodiments that do not include the equalization conduit 155, the imbalance may be compensated by charging the bounce chamber 152 to a greater pressure than the working gas pressure.

Advantageously, the folded back embodiment of the tube spring 156 having inner and outer walls 162 and 164 shown in FIG. 2 permits a shorter and hence a lower mass of the housing 102.

Figure 19:
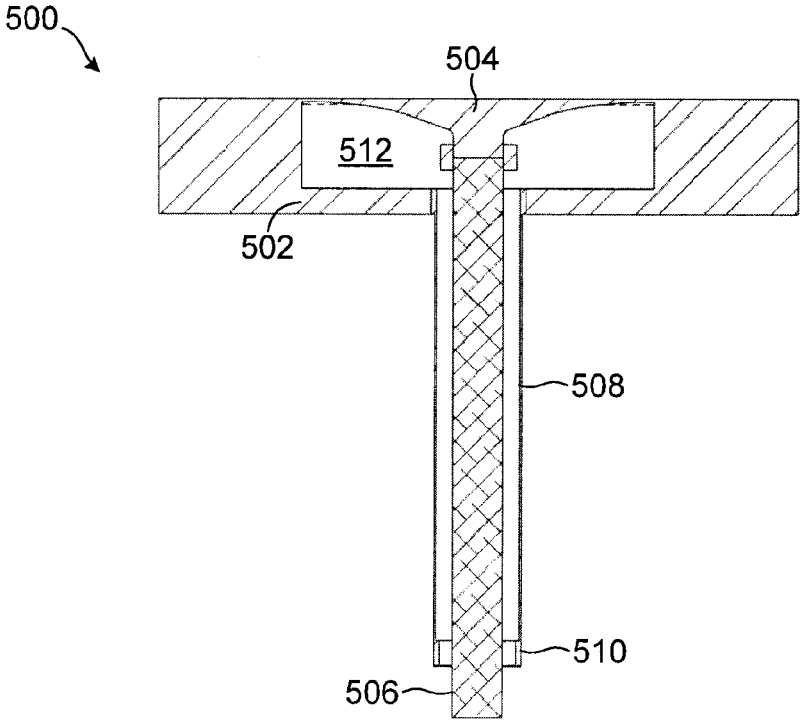
FIG. 19 is a cross sectional view of a tube spring in accordance with an alternative embodiment of the invention.

Referring to FIG. 19, an alternative tube spring embodiment is shown generally at 500. In FIG. 19 only a portion of a housing 502, diaphragm 504, and rod 506 are shown and other components of the transducer are generally as shown in FIG. 2. In this embodiment, a single cylindrical wall tube spring 508 extends between the housing 502 and the distal end of rod 506. The tube spring 508 is rigidly attached to the rod by an annular ring 510, which is also provides a gas tight seal. The housing 502, an under-surface of the diaphragm 504, and the tube spring cylindrical wall together define a bounce chamber 512. Extension and compression of the tube spring 508 permits reciprocating movement of the rod 506 while containing a pressure $P_B$ of a gas in the bounce chamber 512. In this embodiment, the tube spring 508 is indirectly coupled to the diaphragm through the rod 506.

Figure 20:
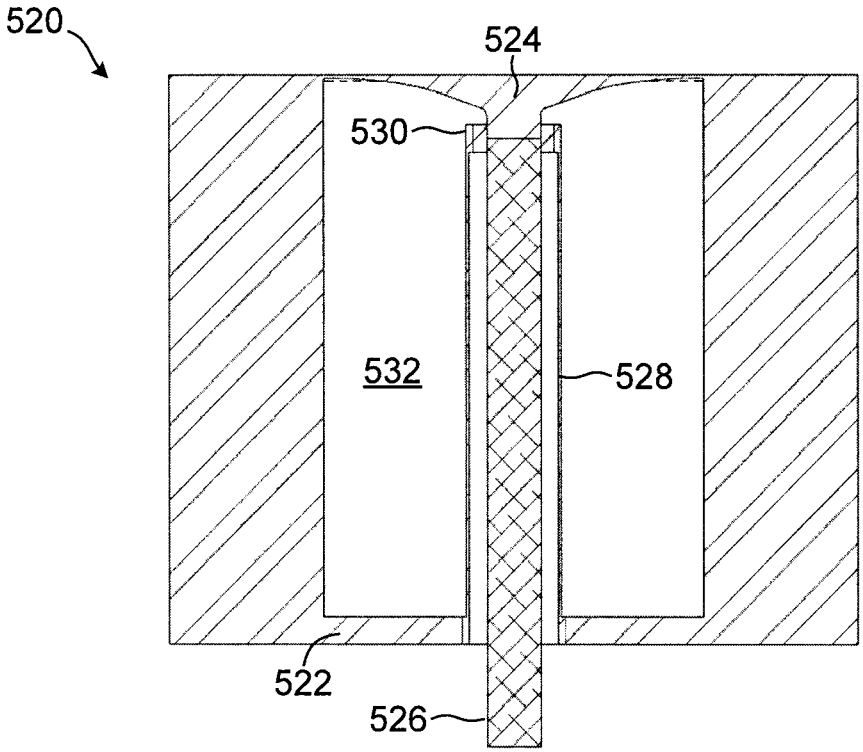
FIG. 20 is a cross sectional view of a tube spring in accordance with another alternative embodiment of the invention.

Referring to FIG. 20, a further alternative tube spring embodiment is shown generally at 520. In FIG. 20, again only a portion of a housing 522, diaphragm 524, and rod 526 are shown and other components are generally as shown in FIG. 2. In this embodiment, a single cylindrical wall tube spring 528 extends between the housing 522 and diaphragm 504. The tube spring is rigidly attached to the diaphragm by an annular ring 530, which also provides a gas tight seal. The housing 522, an under-surface of the diaphragm 524, and the tube spring cylindrical wall together define a bounce chamber 532 for containing pressurized gas.

Second Interface (Displacer)

Referring back to FIG. 2, the displacer 122 includes the first and second flexures 132 and 136, which have respective surfaces 188 and 190. The surfaces 188 and 190 do not permit exchange of gas between the chambers 110 and 112 and the insulating material 180 between the flexures (i.e. the flexures have gas impermeable surfaces).

The insulating material 180 thermally separates the expansion chamber 110 and the compression chamber 112. In one embodiment the insulating material 180 comprises a porous insulating material having a distributed interior volume. The interior volume of the insulating material 180 may be charged with pressurized gas so that the gas impermeable surfaces 188 and 190 do not need to withstand the working gas pressure. The internal volumes of the insulating material 180 and of the displacer 122 may be in communication with the working gas in the expansion and/or compression chambers 110 and 112 through a narrow conduit or pinhole 184 so that when charging the apparatus 100 with the working gas, the insulating material 180 is also pressurized to the same static pressure. The narrow conduit 184 facilitates static pressure equalization while flow through the narrow conduit at on the time scale of the operating frequency is insignificant. The interior volumes of the insulating material 180 are therefore at most weakly connected to the working gas volume so the working gas pressure swings during operation are not transmitted to the insulating material 180. The flexures 132 and 136 must thus withstand only an oscillating differential pressure between the working gas and the gas pressure in the insulating material 180. As stated earlier herein, flexing of the flexures 132 and 136 occurs predominantly in the intermediate flexing portions 135 and 172 of the flexures, which are relatively thin. Under working gas pressure swings, the surfaces 188 and 190 in of the intermediate flexing portions 135 and 172 may nevertheless deform, and the supports 182 preventing such deformations occurring during operation. Advantageously the use of two flexures 132 and 136 permits the flexing surfaces 188 and 190 to provide support to each other since the pressure swings in the chambers are substantially in phase.

In an alternative embodiment, the insulating material 180 may be isolated from the working gas volume and charged with an insulating gas having a lower thermal conductivity than the working gas. In an embodiment where the working gas is a low atomic weight such as hydrogen or helium, the insulating material 180 may be isolated from the working gas volume to prevent mixing of the working gas and the insulating gas and the insulating material 180 may be charged with a heavier atomic weight gas such as argon. Argon has a lower thermal conductivity than hydrogen or helium, and would result in lower parasitic conduction loss through the insulating material 180 and thus higher engine efficiency. Advantageously, argon is in-expensive and does not add significantly toward the operating cost of the engine. Other gasses such as krypton and xenon may also be used as an insulating gas providing even lower thermal conductivity but at increased cost.

The displacement of the displacer 122 is exaggerated for sake of illustration in FIG. 2, while in operation the intermediate flexing portions 135 and 172 are configured to permit reciprocating motion of the displacer 122 with a displacement of about ±200 μm. A thickness profile of the flexures 132 and 136 is selected to permit the desired displacement of the displacer 122 without exceeding the fatigue limit stress in the flexure material, as described above in connection with the diaphragm 128. The supports 182 provide additional possibilities in selecting the thickness profile of the flexures. For example, the intermediate flexing portion 135 and 172 is subjected to the pressure of the working gas, and the supports 182 may be used to provide support, such that the thickness and/or profile of the intermediate flexing portions 135 and 172 may be tailored to provide a desired spring constant for the displacer 122.

The first flexure 132 of the displacer 122 is required to withstand the high working temperature within the expansion chamber 110 when configured as an engine. The top wall 126 of the housing 102 also has a shape and vertical offset configured to accommodate reciprocating motion of the displacer 122 in the expansion chamber 110. The shape and offset reduces an overall volume of the expansion chamber 110 while still permitting displacer motion without overly restricting a minimum chamber height over a central region of the displacer 122. A reduced chamber height may result in increased viscous losses, as described later herein. Advantageously, a shape and offset of the top wall 126 facilitates a smaller chamber height proximate the housing 102 than would otherwise be the case. In FIG. 2, a vertical scale of the offset and shape of top wall 126 has been exaggerated.

Generally, it is convenient if a natural frequency of the displacer 122 is close to or coincident with the natural frequency of the first interface 120. Since the first interface 120 has greater mass (i.e. the combined mass of the diaphragm 128, rod 104, and a mass of a load driven by the rod), the displacer 122 will generally require that a stiffness of the intermediate flexing portions 135 and 172 be less than a combined stiffness of the tube spring 156 and the diaphragm 128.

In general, it is desirable to avoid the need to provide for an external drive for the displacer 122. A zero required external displacer force may be achieved by selecting an effective mass of the displacer 122, the spring constant of the intermediate flexing portions 135 and 172, the effective areas of the first and second surfaces 188 and 190, and mass of the housing 102 using the method disclosed later herein. The effective mass of the displacer 122 is defined in terms of a physical mass of an analogous rigid piston displacer, and takes into account the effect of flexures 132 and 136 and gas dynamic contributions to the mass. If additional spring force is required, it may be provided by an additional flexure 183 between either or both of the first and second flexures 132 and 136. Advantageously, adding the additional interior flexure 183 facilitates tuning of the spring constant of the displacer 122 without changing the effective areas of the surfaces 188 and 190 or the peak stresses in these surfaces. Further details are described later herein under the heading of "Thermoacoustic operational considerations". When the forces acting on the displacer 122 are appropriately balanced, no external displacer driving force is required for the displacer motion.

Correctly predicting and then achieving by design such a balance in actual hardware requires construction of an accurate mathematical model of the specific apparatus. In one embodiment, an external drive for the displacer 122 may be provided to facilitate determination of any small residual out of balance forces, which can then be characterized and compensated for to achieve the zero drive force condition. Subsequent implementations of the compensated design may then omit the external drive. Referring back to FIG. 1, in the embodiment shown, a displacer driver is provided by a voice coil comprised of a magnetic circuit 242 and an annular coil 244. The coil 244 is mechanically coupled to the first interface 122, and a driver force imparted on the first interface may be controlled by controlling an electrical current through the coil.

Gas Passage

As stated earlier herein, flow friction power dissipation increases with working gas velocity and thus increases with increasing frequency. However, provided that increasing frequency is accompanied by a commensurate reduction in stroke, the velocity may be kept constant. However, even if the velocity of an oscillating flow is kept constant, the flow friction will still increase with frequency if the hydraulic radius of the flow passages is larger than the viscous characteristic length. The hydraulic radius or characteristic dimension $r_h$ of a flow passage is:

$$r_h = V_i / A_w \qquad \text{Eqn 3}$$

where $V_i$ is the gas permeable volume inside of the gas passage; and $A_w$ is the wetted surface area of the gas passage.

The viscous characteristic length is:

$$\delta_v = \sqrt{2\mu/\omega\rho} \qquad \text{Eqn 4}$$

Where

μ is the viscosity of the working gas;

ρ is the gas density at the working temperature and pressure; and

ω is the angular frequency of the oscillating flow.

In the case of flow in a structure having a hydraulic radius substantially smaller than the viscous characteristic length, the hydraulic resistance for an oscillating flow is essentially the same as for steady, non-oscillatory flow. In this case, there is sufficient time for the flow to fully develop to a steady flow profile before flow reversal. If however the hydraulic radius is substantially larger than the viscous characteristic length, the hydraulic resistance is larger than for steady flow. The sheared fluid layer is then only approximately as thick as the characteristic length and outside of this boundary layer the flow will be an oscillating plug flow.

An analogous thermal characteristic length gives the scale of the dimensions required for oscillating heat exchange. Only the volume of a substance that is within the characteristic length of the interface separating two substances can participate in mutual heat exchange in the time available as determined by the operating frequency. The characteristic thermal length is:

$$\delta_K = \sqrt{2k/\omega\rho C_p} \qquad \text{Eqn 5}$$

Where k is the thermal conductivity;

ω is the angular operating frequency;

ρ is the gas or material density; and $C_p$ is the material heat capacity at constant pressure.

For gases, the thermal and viscous characteristic lengths are almost the same (The Prandtl number for gasses is close to unity, the Prandtl number being a ratio between viscous diffusion rate and thermal diffusion rate). On the gas side of the heat exchanger the density depends on the pressure and thus the thermal characteristic length decreases as the pressure increases. This is because the thermal conductivity of a gas is largely independent of pressure whereas the volumetric heat capacity $\rho C_p$ is proportional to the number of gas molecules and hence increases with pressure. It is thus more difficult to fully heat or cool a high-pressure gas and this is one of the limits on the operating pressure of the working gas. As the gas pressure or operating frequency is increased, the characteristic dimension of the gas flow passages in heat exchangers should shrink commensurate with the reduction in characteristic length in order to maintain similar thermal contact. Reducing the dimensions of the gas flow passages will however result in increased flow friction losses. The inventors have found that changing the aspect ratio of the regenerator in the passage 146 to have a larger frontal area and shorter flow length mitigates these increased losses.

Figure 10:
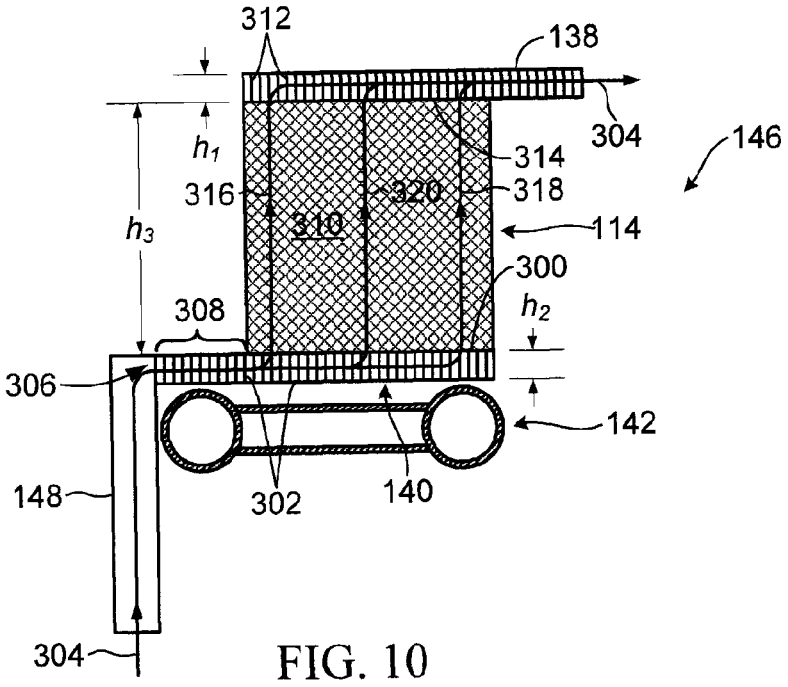
FIG. 10 is an enlarged cross sectional schematic view of a fluid conduit of the Stirling cycle transducer apparatus shown in FIG. 2.

One embodiment of the passage 146 is shown in enlarged detail in FIG. 10. In this embodiment the passage 146 is routed through the insulating material 180 and the flexures 132 and 136 to provide a fluid flow path between the expansion chamber 110 and compression 112 chambers. Referring to FIG. 10, gas flowing from the compression chamber 112 flows through the access conduit portion 148, through the first heat exchanger 140, the regenerator 114, and the second heat exchanger 138. The thickness of the displacer 122 filled with insulation 180, is selected to provide adequate insulation between the expansion chamber 110 and the compression chamber 112. While the heat exchangers 138 and 140 and the regenerator 114 may be configured to occupy the full thickness of the displacer 122, optimal sizing of these elements may dictate a smaller vertical extent for optimal efficiency. The access conduit portion 148 is provided to take up the excess vertical extent to facilitate optimal sizing of the heat exchangers 138 and 140 and the regenerator 114. There are friction, relaxation, and minor losses (due to bends and/or changes in cross-sectional area for example) associated with the access conduit portions 148 as well as a loss of compression due to the increase in working gas volume. The thickness of the displacer 122 may be selected such that the combined losses due to inclusion of the access conduit portions 148 and the thermal conduction losses between the expansion and compression chambers through the displacer insulation are minimized.

Second Heat Exchanger

When operating the apparatus 100 as an engine, the second heat exchanger 140 acts as a cold heat exchanger for cooling the gas. A height $h_2$ of the second heat exchanger 140 causes a gas flow 304 to undergo a change in mean flow direction from generally vertical flow in the access conduit portion 148 to generally transverse flow through the second heat exchanger. Advantageously, this change in gas flow direction facilitates heat extraction while the gas is flowing transversely. The second heat exchanger 140 includes a plurality of vertically extending thermally conductive pins or fins 302 in the path of the gas flow 304.

The second heat exchanger 140 also includes a substantially transversely extending interface 300 in communication with the regenerator 114. In the embodiment shown, a lateral dimension of the second heat exchanger 140 is much larger than the height $h_2$ and thus a much larger conduction area is available for heat flow through the conductive pins 302 in the vertical direction than would be available if the pins were oriented horizontally. In addition, the distance heat needs to be conducted along the pins is much shorter than if the pins were oriented horizontally. Furthermore, the second heat exchanger 140 may be wider than the regenerator 114 such that the gas flow 304 at an entrance 306 of the second heat exchanger has a minimum interaction length 308 with the conductive pins 302 before entering the regenerator 114. The gas flow 304 through the second heat exchanger 140 undergoes a further flow redirection from generally transverse flow to generally vertical flow proximate the interface 300.

When operating the apparatus 100 as an engine, the heat transport conduit 142 carries a cooling heat exchange fluid such as water. Heat extracted in the second heat exchanger from the working gas by the thermally conductive pins 302 is conducted to the heat exchange fluid. Advantageously, by redirecting gas flow as described, heat conduction occurs in the same nominal direction as the gas flow in the regenerator 114, and thus a more substantial cross-sectional area is available for heat conduction between conductive pins 302 and the heat transport conduit 142, thereby minimizing a temperature difference between the working gas and the heat transport fluid. In contrast, prior art engines have attempted to remove heat perpendicular to the regenerator gas flow direction, resulting in a much smaller cross-sectional area for heat transfer.

Regenerator

In this embodiment, the regenerator 114 is constructed from a matrix 310 of porous material such as a micro capillary array, porous ceramic or packed spheres. Alternatively, a stacked wire screen or wound wire regenerator, may also be used. The pore hydraulic radius of the matrix 310 calculated in accordance with Eqn 3 should be less than the thermal characteristic length calculated in accordance with Eqn 4, such that a local gas temperature in the regenerator 114 will be substantially the same as a temperature of the local matrix 310. The local temperature varies from one end of the regenerator to the other. If this condition is met, thermal relaxation losses in the gas flowing through the regenerator will be negligible. However, small pore dimensions of the matrix 310 will result in relatively large flow friction losses. Advantageously, the regenerator 114 has a large cross sectional area perpendicular to the gas flow 320, and a relatively short vertical extent $h_3$ resulting in a short gas flow length through the matrix 310. Furthermore, the number of pores in the matrix 310 is selected such that the velocity of gas flow 320 and hence the flow friction losses are optimally balanced against regenerator heat exchange effectiveness.

In the embodiment shown, the full hot to cold temperature gradient experienced by the apparatus 100 appears across the regenerator 114 and thus the matrix 310 should be a good thermal insulator in order to reduce unproductive thermal conduction across the regenerator, which results in losses. The matrix 310 will absorb heat from the working gas during a hot to cold blow and the matrix walls will increase in temperature. This means that gas exiting the regenerator 114 toward the end of the blow will be hotter than at the beginning of the blow since the gas temperature in the regenerator is isothermal with the walls of the matrix 310. This constitutes unwanted extra heat transferred to the second heat exchanger 140, which must be removed by the second heat exchanger. Similarly, on a cold to hot blow the walls of the matrix 310 will be reduced in temperature towards the end of the blow due to the matrix transferring heat to the gas. The temperature of gas exiting the regenerator 114 will thus be colder at the end of the blow than at the beginning. This constitutes a temperature deficit that needs to be made up by the first heat exchanger 138. The matrix 310 should thus have sufficient thermal capacity to store the heat associated with a hot to cold or cold to hot blow without appreciably changing in temperature. Suitable regenerator matrices are described in U.S. Pat. No. 4,416,114 to Martini, which is incorporated herein by reference in its entirety.

First Heat Exchanger

When operating the apparatus 100 as an engine, the first heat exchanger 138 acts as a hot heat exchanger for heating the gas. The first heat exchanger 138 is in thermal communication with an external heat source and conducts heat to gas flowing into and out of the expansion chamber 110. A height $h_1$ of the first heat exchanger 138 causes the gas flow 304 to undergo a further change in mean flow direction from generally vertical flow in the regenerator 114 to generally transverse flow through the first heat exchanger. As in the case of the second heat exchanger, this change in gas flow direction facilitates transfer of heat to the gas while flowing transversely. The first heat exchanger 138 includes a plurality of vertically extending thermally conductive pins or fins 312 in the path of the gas flow 304.

As the gas flow 304 leaves the regenerator 114 and through the hot exchanger, it undergoes a substantial change in mean flow direction at an interface 314 between the regenerator and the first heat exchanger 138. This change in gas flow direction makes available a larger cross-sectional area for conduction of heat into the engine. The first heat exchanger 138 may also be wider than the regenerator 114, which then provides a minimum interaction length for the gas flow 304 with the pins or fins 312. In addition, the extra width compensating for the extra width at the second heat exchanger 140 causes the flow resistance for flow path portions 316, 318, and 320 of the gas flow 304 through the regenerator 114 and first heat exchanger 138 to be very similar, even if the regenerator matrix 310 is not configured for sideways flow redistribution. Consequently, the gas flow 304 through the regenerator will be evenly distributed as shown generally at 316-320.

Referring back to FIG. 2, in the embodiment shown the externally provided thermal energy 200, is conducted into the apparatus 100 through the housing 102. Thermal energy is conducted into the conductive pins 312 of the first heat exchanger 138 in substantially the same orientation as the gas flow 320 through the regenerator 114. Advantageously, the extended transverse extent of the first heat exchanger 138 provides sufficient cross-sectional area to keep a heat flux density through the heat exchanger to manageable levels.

Alternatively, in other embodiments a heat transfer conduit similar to the heat transfer conduit 142 may be provided to conduct thermal energy between a hot heat transfer fluid and the first heat exchanger 138. In the engine embodiment shown in FIG. 1, heat is provided by cartridge heaters 240 for the purposes of testing the engine apparatus 100.

Thermoacoustic Operational Considerations

As stated above, at high frequencies and/or pressures, neglecting to take account of the inertia of the working gas leads to inaccuracies in mathematical modeling of the operational behavior of the apparatus 100.

Figure 11:
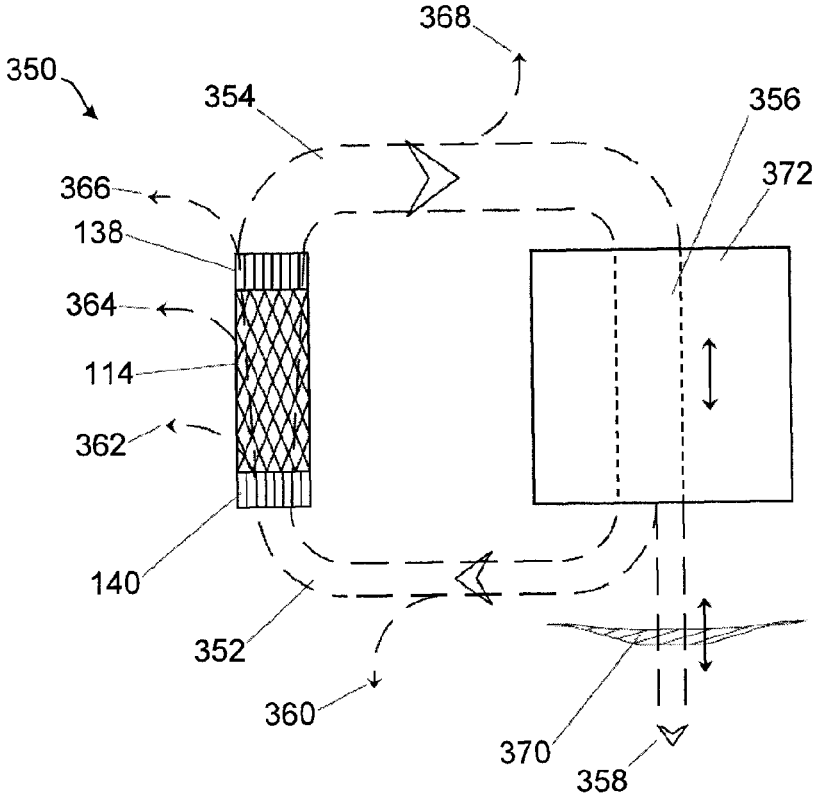
FIG. 11 is a schematic view of acoustic power flow in the Stirling cycle transducer apparatus shown in FIG. 2.

Referring to FIG. 11, the acoustic power flow in the apparatus 100 is shown schematically at 350. The first interface 120 shown in FIG. 1 is represented schematically at 370 and for convenience will be referred to in the following description using the term "diaphragm". The second interface shown in FIG. 1 is represented schematically at 372 and for convenience will be referred using the term "displacer". During steady state operation of the apparatus 100 shown in FIG. 1 as an engine, the diaphragm 370 and the displacer 372 oscillate with fixed amplitudes. The reciprocating motion of the displacer 372 leads the reciprocating motion of the diaphragm 370 by some phase angle (for example 45°). The oscillation causes pressure swings and flows of the working gas in the volume defined between the respective surfaces 150 and 190 of the diaphragm 370 and the displacer 372. The working gas flows and accompanying pressure swings correspond to an acoustic power flow 352 in the compression chamber 112 traveling from the compression chamber through the second (cold) heat exchanger 140, through the regenerator 114, and through the first (hot) heat exchanger 138 into the expansion chamber 110. The arrowheads in FIG. 11 indicate an acoustic power circulation direction.

The regenerator 114 keeps the working gas at substantially the same temperature as the temperature of the regenerator matrix 310, since the hydraulic radius corresponding to pores in the matrix is smaller than the thermal characteristic length (Eqns 3 and 4). The temperature gradient across the apparatus 100 appears across the regenerator 114, with the temperature increasing from the compression chamber 112 to the expansion chamber 110. Accordingly, as the working gas flows from the compression chamber 112 to the expansion chamber 110, a volume flow rate increases since the temperature is increasing, the pressure is approximately equal throughout the regenerator 114, and a mass of the working gas is conserved. This may be qualitatively understood as following from the ideal gas law PV=nRT.

Increasing volume flow amplitude corresponds to increasing acoustic power and thus the acoustic power flowing out of the regenerator 114 is larger than the acoustic power flowing into the regenerator. The regenerator 114 thus acts as an acoustic power amplifier with energy being provided by the temperature difference across the regenerator. The heat exchangers 140 and 138 function to maintain this temperature difference by transferring heat in and out of the engine. An increasing width of the dashed outline symbolizing acoustic power flow through the regenerator 114 is used to indicate this power increase, resulting in an amplified acoustic power 354.

The displacer 372 absorbs the amplified acoustic power 354 in a volume associated with the expansion chamber 110 (hereinafter the expansion space) and transfers the power back to a volume associated with the compression chamber 112 (hereinafter the compression space) as illustrated by the dotted outline 356. As depicted in FIG. 11, the outline 356 is dotted rather than dashed, since the acoustic power is transferred by the oscillation of the displacer 372 and not transmitted through the working gas, as is the case in the remainder of the loop 350. A power returned by the displacer 372 is greater than a steady state acoustic power flowing out of the compression chamber 112 and the difference flows out through reciprocating motion 358 of the diaphragm 370, which represents the useful output power of the engine. FIG. 11 has been drawn to suggest an analogy to traveling wave thermoacoustic engines, where there is no displacer 372. Rather, in such traveling wave thermoacoustic engines, the acoustic power returns through a volume of working gas. Using the motion of a mechanical displacer 372 to return the acoustic power has the advantage of greatly reducing an engine size as well as removing any possibility of gas streaming. Streaming is a bulk circulation of working gas around the loop in a thermo acoustic engine, and introduces unwanted heat transfer from the hot to cold sides, as hot gas streams to the cold side and cold gas streams to the hot side. In contrast, acoustic power is the back and forth oscillation of the gas mass without any net motion around the loop. Streaming is caused by second order thermoacoustic effects.

The operation, as described in connection with FIG. 11, is for a beta configuration engine. In an alpha configuration engine, a second diaphragm (or piston) absorbs the acoustic power in the expansion space and transfers it back to a compression space first diaphragm by either external mechanical means or external electrical means coupled between the first and second diaphragms. The beta configuration apparatus conveniently provides acoustic power return through motion of the displacer 372 as shown in FIG. 11.

In any non-idealized engine there are losses associated with the above described process. In the compression chamber 112, there are viscosity and thermal relaxation losses 360 that reduce the acoustic power. Similarly, there are losses 366 and 362 in the respective heat exchangers 138 and 140, losses 364 in the regenerator 114, and losses 368 in the expansion chamber 110. These losses all act to reduce the acoustic power by converting acoustic power to heat, and may be minimized by optimizing dimensions and design of the engine as described herein. In addition to direct acoustic power losses, there are also non-productive heat transfer losses to consider. For instance, conduction of heat through the regenerator matrix 310 does not contribute to useful engine output power. Residual ineffectiveness of the regenerator 114 also contributes additional non-productive heat transfer. Thermoacoustic theory provides suitable methods for taking these losses into account and for optimizing dimensions to achieve optimal performance of the apparatus 100.

Figure 12:
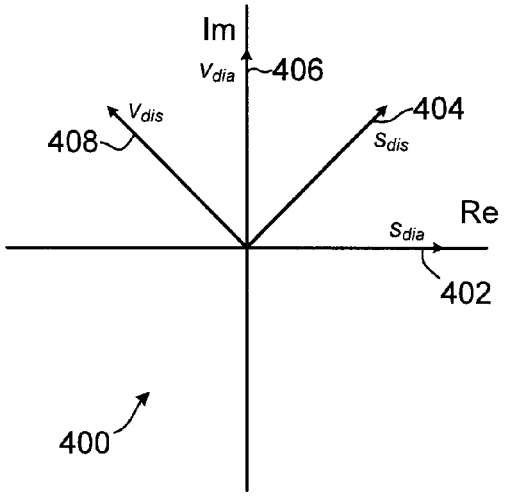
FIG. 12 to FIG. 16 are a series of graphical phasor diagrams depicting relative phasing between variables associated with acoustic power flow in the Stirling cycle transducer apparatus shown in FIG. 2.

Referring to FIG. 12, a phasor diagram showing the relative phasing of the dynamic variables associated with the acoustic power flow (shown in FIG. 11) is shown generally at 400. All dynamic variables are implicitly assumed to vary sinusoidally in this thermoacoustic model and may be conveniently represented as complex variables. These complex variables may be represented as phase vectors (known as "phasors") on a phasor diagram 400, where a real component is plotted along the x-axis and an imaginary component is plotted along the y-axis.

Figure 13:
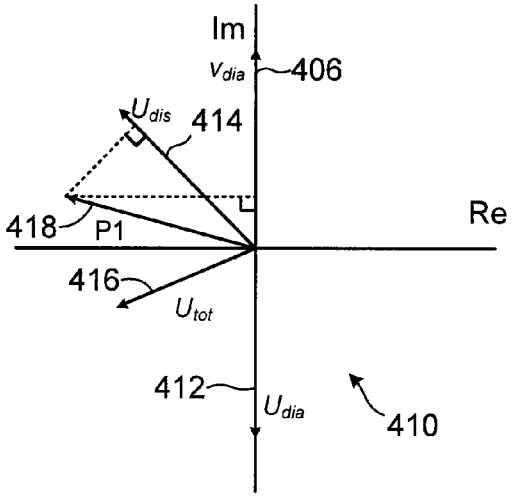
Figure 14:
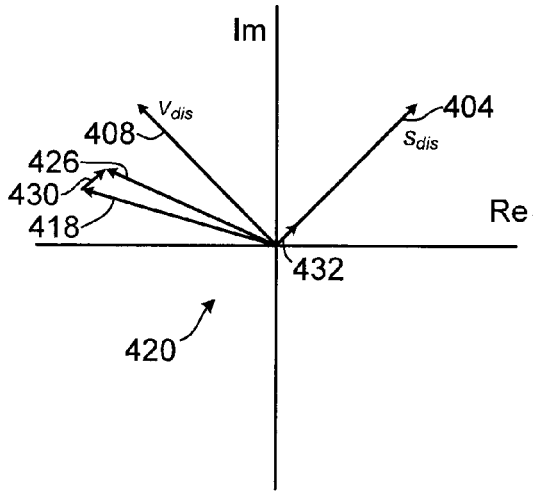

FIG. 12 to FIG. 14 depict four types of phasors representing position (S), velocity (V), volumetric gas flow (U), and pressure (P). All phasor types are given unit reference lengths, however for phasors of the same type, the respective lengths indicate relative magnitude between these phasors. The phasor diagram 410 only provides an approximate representation of the volumetric flow phasor, Actual flow phasor lengths and angles would need to be calculated thermoacoustically and vary continuously throughout the apparatus. However the results are qualitatively very similar. The angles between respective phasors are representative of the phase relationship between the corresponding dynamic variables. The phasor diagram 400 has a diaphragm position phasor 402 ($S_{dia}$), having an arbitrarily assigned phase angle of 0°. A displacer position phasor 404 ($S_{dis}$) leads the diaphragm position phasor 402 by 45°. The corresponding velocity phasors are found by multiplying by iω where ω is the angular frequency and i is the square root of −1. Corresponding diaphragm and displacer velocity phasors 406 ($V_{dia}$) and 408 ($V_{dis}$) thus lead their respective position phasors $S_{dis}$ and $S_{dia}$ by 90°. The diaphragm 370 and displacer 372 are taken to have equivalent amplitudes and effective areas in this analysis. Motion of the diaphragm and displacer 370 and 372 causes gas flow in the chambers. The sign convention is such that a positive velocity of the diaphragm 370 is down in FIG. 11 and corresponds to a gas flow towards the center of the diaphragm 370, which is counter clockwise and hence negative with respect to the positive flow direction in FIG. 11.

Referring to FIG. 13, a diaphragm induced volumetric gas flow phasor 412 ($U_{dia}$) in the compression space is thus substantially opposite to the diaphragm velocity $V_{dia}$ (i.e. phasor 406 in FIG. 13). The displacer induced flow in the compression space is for positive displacer velocity (down in FIG. 11) in the clockwise direction and hence positive. Phasor 414 is the displacer-induced flow ($U_{dis}$) in the compression space and is substantially in the same direction as the displacer velocity phasor shown at 408 in FIG. 12. The total volumetric gas flow in the compression space is the vector sum of the diaphragm and displacer induced flows (i.e. $U_{dia}$ and $U_{dis}$) and is represented by a phasor 416 ($U_{tot}$), which is of shorter length since there is partial flow cancellation. An actual thermoacoustically calculated compression space pressure phasor is shown at 418 (P1) for the engine of FIG. 11. Since the expansion and compression chambers 110 and 112 are connected by low flow friction gas flow passages and a dimension of the engine as measured along the acoustic power loop shown in FIG. 11 is much shorter than a sound wavelength at the operating frequency, the pressure phasor 418 is almost the same everywhere in the engine. The pressure phasor 418 is calculated at the center of the compression chamber 112, but pressure phasors elsewhere in the engine are very similar. The positive direction of diaphragm motion has been assigned to be in the direction that increases the working gas volume in the engine (i.e. down in FIG. 11) and consequently positive diaphragm displacement, which causes increased working volume, decreases the pressure in the engine. The pressure phasor 418 is thus expected to be nearly 180° out of phase with the diaphragm motion $S_{dia}$ (phasor 402), which is satisfied by the calculated phasor 418.

The acoustic power is given by:

$$P_{ac}=\tfrac{1}{2}\cdot Re[U1\cdot P1^*] \qquad \text{Eqn 6}$$

where

U1 is the complex variable representation of the volumetric gas flow; and

P1* is the complex conjugate of the complex variable representation of the gas pressure amplitude.

From the above equation, the acoustic power removed by the diaphragm is proportional to a projection of P1 (i.e. the phasor 418) on diaphragm induced U1 (i.e. the phasor 412). FIG. 13 shows the projection of P1 on both diaphragm and the displacer induced flows $U_{dia}$ and $U_{dis}$. For the relative phase angles as illustrated, the projection of P1 on the diaphragm-induced flow $U_{dia}$ is negative and represents acoustic power removed from the clockwise acoustic power loop of FIG. 11. This represents the useful output of the engine. Given the phase difference in the respective motions of the diaphragm and displacer, the projection of P1 on the displacer induced flow $U_{dis}$ (phasor 414) is greater than the projection of P1 on the diaphragm induced flow $U_{dia}$ (phasor 412). Thus, the acoustic power input due to displacer motion is larger than the acoustic power removed by the diaphragm. The effect of the displacer on the expansion and compression chamber volume gas flows is equal provided the surfaces 188 and 190 of the respective flexures 132 and 136 have equal effective areas and the displacer faces are rigidly spaced a fixed distance apart. The positive direction of volume gas flow is taken as counter clockwise in FIG. 11. Thus, under the current assumptions equal power is removed from the expansion space by the displacer as is provided to the compression space by the displacer.

Displacer Drive

The pressure phasors in the expansion and compression spaces are however not exactly equal due to flow friction and gas inertia. Referring to FIG. 14, the displacer position phasor $S_{dis}$ is shown at 404, the displacer velocity phasor $V_{dis}$ at 408, the calculated expansion space pressure phasor at 426, and the calculated compression space pressure phasor at 418. The pressure difference is the vector 430, which is shown translated to the origin at 432. This pressure difference appears across the displacer and corresponds to a force acting on the displacer. Thus, even with equal effective areas of the first and second surfaces 188 and 190 of the displacer, the pressure difference may produce a displacer driving or damping force. In this particular case, the pressure difference is almost exactly in phase with the displacer position phasor 404. The pressure difference across the displacer thus acts primarily as an additional effective displacer mass and its origin is the pressure difference required to provide the oscillating acceleration for the inertia of the working gas. The gas dynamics thus affects the natural oscillation frequency of the displacer 122 and must be taken into account when designing the moving mass and mechanical spring force of the displacer. In this particular case, the projection of the pressure difference onto the displacer velocity vector 424 is very small so the displacer is not substantially driven or damped by the engine gas dynamics. Small changes in the displacer surface effective areas can provide either damping or displacer drive by producing a non-zero projection of the pressure difference phasor onto the displacer velocity phasor.

The result shown in the phasor diagram of FIG. 14 only accounts for displacer drive components due to working gas dynamics as calculated thermoacoustically. These forces are generated internal to the housing 102 and in the absence of any external forces acting on the engine, a center of mass of the apparatus remains fixed in space. Thus, in the operation of the apparatus, the housing has a reciprocating complementary vibration having an amplitude dependent on the ratios of the housing mass to the masses of the moving interfaces. The mass ratio of the housing to the heavier interface 120 provides the dominant contribution. Any damping and spring force provided by a mounting structure (not shown) to which the housing may be secured provides an external force acting on the center of mass which also needs to be taken into account to calculate the magnitude and phase of the housing motion. Referring back to FIG. 2, the displacer 122 is attached to the housing 102 at the peripheral portions 133 and 170, but due to the flexing provided by the intermediate flexing portions 135 and 172, the central portions 134 and 174 will not move in lock step with the housing.

The displacer may be thought of as a rigid center (portions 134 and 174) with an effective mass sprung to the housing 102 and an effective spring constant due to the intermediate flexing portions 135 and 172. In such a dynamic model of the system, an effective mass of the displacer due to the peripheral portions 133 and 170 is assigned to the housing 102, since this portion of the displacer 122 is assumed to move rigidly with the housing. The rigid center of the displacer 122 moves separately from the housing and is assigned an effective moving mass. The intermediate flexing portions 135 and 172 are modeled as mass-less springs characterized by a spring constant. The vibrating motion of the housing 102 imparts a driving force on the rigid center section of the displacer 122 whenever there is a displacement of the housing relative to the center section due to flexure in the portions 135 and 172. A magnitude of this driving force may be controlled by adjusting the mass of the housing 102 and a mass of a mounting structure to which the housing is mounted. Increasing the mass of the mounting structure reduces the magnitude of the vibration of the housing 102 and thus reduces the driving force on the rigid center section of the displacer 122.

Alternatively or additionally dynamic balancing of the apparatus 100 may be employed such as adding a second cylinder to the apparatus 100, which operates 180° out of phase with the reciprocating components shown in FIG. 2. In another embodiment, by employing dynamic balancing of the housing 102, the displacer driving force due to motion of the housing may be largely eliminated. A single cylinder engine may also be balanced by driving a mass attached to the apparatus by a spring 180° out of phase with the mass weighted phasor sum of the motions of the first and second interfaces. Housing vibration is not required for transducer operation since gas pressure forces alone can drive the diaphragm with suitable choices for the effective areas as discussed above.

The magnitude and sign of the gas pressure force on the first and second surfaces 188 and 190 may be adjusted by adjusting the ratio of the first surface 188 and second surface 190 effective areas. In FIG. 2 the displacer 122 as shown has non-equal areas of the central portion 134 of the first flexure 132 and the central portion 174 of the second flexure 136. The area of the central portion 174 is about 10% greater than the area of the central portion 134, such that forces acting on the displacer 122 and the natural frequency of the displacer are adjusted to result in a desired reciprocating motion of the displacer 122 that for an engine leads the reciprocating motion of the first interface 120 by a phase angle. In one embodiment a phase angle of approximately 45° is desirable, but in other engine embodiments angles other than 45° are also possible.

The gas pressure forces acting on the displacer 122 may be computed by constructing a mathematical model of the apparatus 100 taking account of thermoacoustic effects (as described in detail later herein). In the mathematical model, the desired reciprocating motion amplitudes for the first interface 120 and the displacer 122 are specified along with a desired relative phase angle between these motions (e.g. 45°). The desired reciprocating motion forms an input for the mathematical model, which is used to calculate pressure, amplitude, and pressure phase angle, at all points throughout the working volume of the apparatus 100. Integrating pressure over both the first and second surfaces 188 and 190 of the displacer 122 results in a net computed gas pressure force acting on the displacer since the surfaces are connected together by substantially rigid supports 189. At a location proximate the peripheral supports 133 and 170, the resulting force on the surface acts primarily on the housing 102, while over the central portions 134 and 174 the same pressure force acts primarily on the effective moving mass of the rigid center of the displacer 122. A fraction of the force contributing to driving the effective mass of the center of displacer 122 at a specified radius is determined by scaling the calculated force at that radius by a ratio between the reciprocating motion amplitude at that radius and a maximum amplitude (for example, an amplitude at the center of the displacer 122). The result of the pressure integration over either the first surface 188 or the second surface 190 is a force phasor acting on the moving effective mass of the displacer as well as a force phasor acting on the housing 102.

Alternatively, the calculation may be interpreted as producing an average pressure phasor acting on an effective area of a surface of the displacer 122 that is a fraction of a true surface area of that surface. A remaining surface area multiplied by the average pressure phasor produces a force on the housing 102.

Using the above methods, force phasors representing a net force acting on the rigid center section of the displacer 122 and representing a net force acting on the housing 102 may be calculated from the gas pressure acting on the surface 188. Similarly, force phasors acting on the rigid center section 132 and housing 102 may be calculated from gas pressure acting on the second surface 190. Even if the effective areas of surfaces 188 and 190 were equal the respective forces acting on the first and second surfaces 188 and 190 are close in magnitude, but not exactly equal, and are approximately opposite in phase. The respective forces acting on the first and second surfaces 188 and 190 are not equal since the gas pressure amplitude and phase are not exactly equal in the expansion chamber 110 and compression chambers 112 due to gas viscosity and inertia. The net force acting on the moving center of the displacer 122 and the net force acting on the housing 102 is the vector sum of the respective components calculated over the first and second surfaces 188 and 190 of the displacer 122

In the same manner, the mathematical model may be applied to yield a net force on the diaphragm 128, where a separate thermoacoustic calculation is used to account for the effects of the bounce chamber 152 (if the gas volume in the bounce chamber constitutes a significant gas spring).

For the dynamic model of the system there are three significant motions. These are the motions of the first interface 120, the displacer 122 and the motion of the housing 102. The magnitude and phase of each of these three motions are conveniently mathematically represented by phasors in the complex plane. The velocity phasors thus lead their corresponding displacement phasors by 90°.

Three force phasors may thus be calculated for the displacer 122, the diaphragm, and the housing 102. These force phasors may be resolved into a components aligned with the corresponding reciprocating motion phasors, which depending on the sign of the projection behaves, as either an extra spring force or extra effective mass. Additionally, the force phasors may be resolved into components aligned with the velocity phasors, which depending on the sign of the projection is interpreted as either a damping or a drive coefficient. The resulting spring like and damping like components (calculated from the thermoacoustic model) for the displacer 122, the diaphragm, and the housing 102 are then added to the purely mechanical contributions in an otherwise standard three mass coupled oscillator calculation and the required additional external displacer and diaphragm forces calculated for the desired steady state operation. Three mass coupled oscillator calculations are described in Marion, "Classical Dynamics of Particles and Systems" 2nd edition, J. B. Marion, Academic Press (1970), which is incorporated herein in its entirety. By external displacer and diaphragm forces is meant any force that is not due to gas pressures acting on, or mechanical spring constants of the elements shown in FIG. 2. The calculated external displacer force acts between the center portion of the displacer 122 and the housing 102, while the external diaphragm force acts between the first interface 120 and the housing 102.

The calculated external force phasor on the diaphragm required for steady state operation may be resolved into a component aligned with the displacement phasor of the diaphragm and a component aligned with the corresponding velocity phasor. A non-zero component aligned with the displacement phasor corresponds to a spring like force and this external component may be eliminated by making a corresponding adjustment to the mechanical spring constant of the diaphragm 128 or tube spring 156 or to the mass of the first interface. A non-zero component aligned with the velocity phasor corresponds to an external drive or damping requirement.

If apparatus 100 is configured as an engine, it will produce power and thus at a minimum the load (not shown) attached to rod 104 should provide a damping force acting between the rod (which is part of interface 120) and the housing 102. Without such a damping force (which corresponds to making use of the power generated by the engine), an amplitude of reciprocating motion of the first interface 120 would grow, which by definition does not constitute steady state operation. A magnitude of the generator-induced damping may be adjusted by changing an apparent load resistance seen by the generator, which may be done by the power conversion electronics attached to the generator.

If the external displacer drive or damping needed for steady state operation is not zero then a displacer drive connected between the rigid center of the displacer 122 and the housing 102 must supply or remove power from the system. Given the relatively large spacing between the surfaces 188 and 190 it is possible to put a small actuator (such as the voice coil actuator shown in FIG. 1) in between the flexures 132 and 136, at the expense of displacing some of the insulating material 180. It is however advantageous to design the apparatus 100 such that the required external displacer force is zero as will be discussed later herein.

Figure 15:
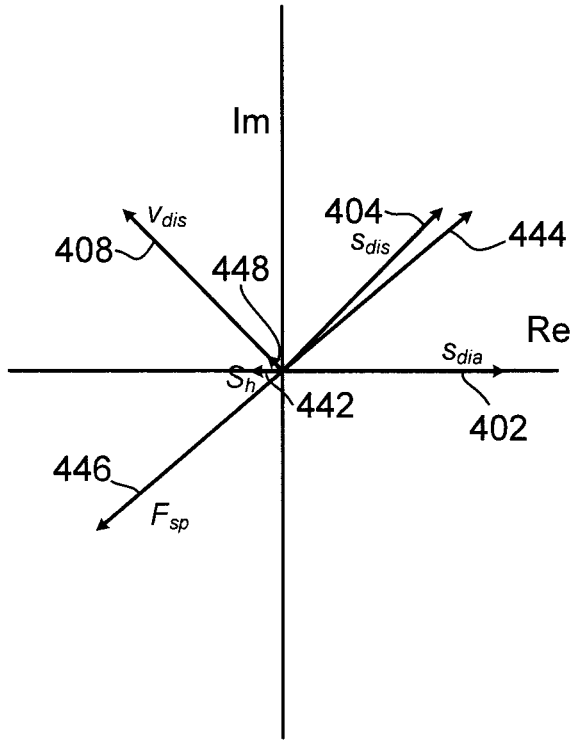

Phasor representations of displacer drive taking housing vibrations and gas dynamics into account are shown in FIG. 15 and FIG. 14. Referring to FIG. 15 the displacer motion phasor $S_{dis}$ is again shown at 404 and the corresponding velocity phasor $V_{dis}$ at 408. A housing motion phasor $S_h$ is shown at 442 and is much smaller and predominantly out of phase with the diaphragm motion phasor 402 ($S_{dia}$), since the center of mass of the apparatus remains fixed and the housing mass is much larger than the mass of the diaphragm and any attached load. The spring force acting between the housing 102 and the rigid center portion of the displacer 122 depends on the relative motion between the displacer and the housing, which is represented by the vector difference between phasors 404 and 442. This vector difference is depicted as a phasor 444 after translation to the origin. The spring force due to intermediate flexing portions 135 and 172 acting between the housing 102 and the center of the displacer 122 opposes this relative motion and is thus represented as force phasor 446. Note that while the projection of the phasor 446 on to the displacer motion phasor 404 is a spring force as expected, there is also a small but non-zero projection 448 of the phasor 446 onto the velocity phasor 408. This projection, since it is positive and non-zero constitutes a driving force that must be added to the gas dynamic contribution force to obtain the total force acting on the rigid center of the displacer 122. The magnitude of the housing vibration driving force depends on the mass ratio of the housing to the moving effective mass of the displacer and decreases with increasing housing mass.

Figure 16:
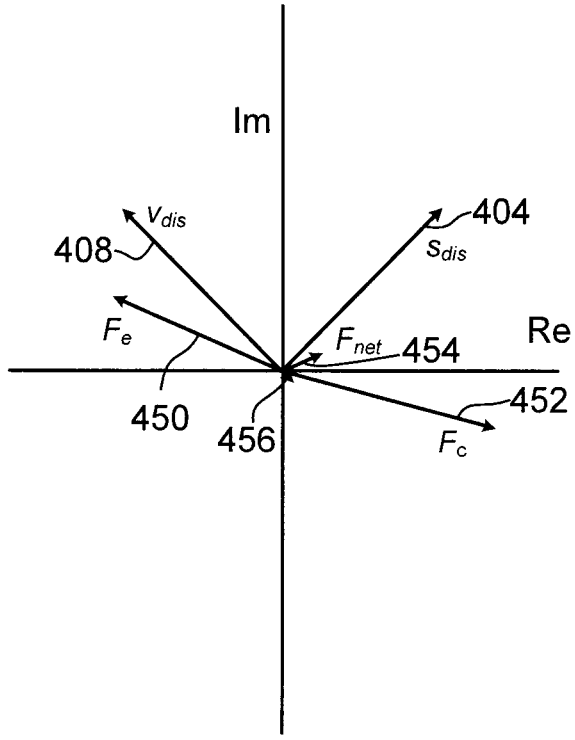

A non-zero vector sum of the housing vibration drive contribution and the gas dynamic force contribution implies that the displacer must either be driven or power must be extracted from the displacer, depending on the sign of the sum. In either case, this may be accomplished by providing an actuator as described above, and which may be configured to provide power or to extract power from the displacer 122. It is however, advantageous in a low cost Stirling engine design to avoid the need to add a displacer drive, and thus desirable to achieve a balance resulting in zero drive requirement. A zero drive requirements may be achieved by precise selection of the effective areas of the displacer first and second surfaces 188 and 190. The expansion side force phasor 450 ($F_e$) shown in FIG. 16, is the product of the effective area of the first surface 188 and the magnitude of the expansion side effective pressure phasor 426. The expansion side force phasor angle is the same as the effective pressure phasor angle, which is approximately the same as the expansion side center pressure angle, but not exactly the same since the phase of the pressure is not completely constant over the surface of the displacer. Similarly, the compression side force phasor 452 is the product of the effective area of the second surface 190 and the magnitude of the compression side effective pressure phasor 418. With the sign convention of FIG. 11 (positive direction down), the phasor angle of the compression side force is almost 180° out of phase with the expansion side force phasor, since on the surface 190 the pressure opposes the force from the expansion side.

In the phasor diagram example shown in FIG. 16, the larger effective area of the surface 190 relative to the effective area of the surface 188 has been taken into account. This corresponds to the embodiment shown in FIG. 2, where the central portion 174 is 10% larger that the central portion 134. Note that since the resultant force phasors are in line with the effective pressure phasors, both forces have non-zero projections onto the displacer motion phasor 404 and displacer velocity phasor 408. The net force 454 acting on the displacer center is the vector sum of the expansion side 450 and compression side 452 forces. The projection of this net force onto the displacer velocity 408 is the gas dynamic contribution to the displacer drive or damping. The magnitudes of the largely opposing force phasors 450 and 452 may be adjusted by varying the effective areas of one or both of the expansion and compression side surfaces 188 and 190. Relatively small changes in effective area ratio will have a large effect on magnitude and direction of the net force 454. Note that changing the effective area of a displacer surface will also change the force projection of 454 onto the displacer motion phasor 404, which is like changing the effective spring force or the effective mass of the displacer. A change of effective area of a displacer surface will thus require a commensurate change in displacer mechanical spring force or the displacer mass in order to keep the resonant frequency of the displacer at a desired natural frequency for the reciprocating motion. Changing the effective area of one of the displacer surfaces will also have a secondary effect on the gas flow in the apparatus and thus cause changes to the pressure phasors 418 and 428 in the compression and expansion chambers respectively. However, small changes in the effective areas cause large changes in net displacer force but only small changes in the gas pressures. Thus, an iterative calculation will rapidly converge.

A change in effective area of one of the first and second surfaces 188 and 190 may be accomplished by changing the actual area of the surface.

Alternatively, the change in effective area may be accomplished without changing the actual area of the surface. Referring back to FIG. 2, the first and second flexures 132 and 136 extend outwardly from a center of the displacer 122 all the way out to a wall 192 of the housing 102. As depicted, the areas of the first and second surfaces 188 and 190 are equal but the effective areas are not. The effective area of a flexing surface is calculated by integration, which in the common axial symmetry case may be written as:

$$A_{eff} = 2\pi \int_0^{r_o} \frac{z(r)}{z(0)} r dr, \qquad \text{Eqn 7}$$

where z is the local vibration amplitude of the surface as a function of the radius r;

z(0) is the center amplitude of the surface,

And $r_o$ is the outer radius of the surfaces.

Each differential area annulus thus contributes to the effective area in proportion to the size of its motion. Thus, the edges of the flexure that are attached to the wall 192 contribute nothing, while the moving center of the displacer contributes its full area to the calculated effective area. Similarly, the force due to pressure swings acting on a flexure surface is given by:

$$F_1 = \pm 2\pi \int_0^{r_o} P_1(r) \frac{z(r)}{z(0)} r dr, \qquad \text{Eqn 8}$$

where $P_1(r)$ is the pressure phasor as a function of radius; and $F_1$ is the resulting force phasor acting on the dynamic system constituted by the moving center portion of the flexure and any attached masses and springs.

The sign of the force is either positive or negative depending on the sign convention and the surface of interest. In the cases under consideration the phase of the pressure varies only slightly over the surface in which case we can often use the approximation:

$$F_1 \approx \pm A_{eff} \cdot P_1(0), \qquad \text{Eqn 9}$$

The remaining force of the working pressure acting on the entire actual area of the surface acts on the wall 192 of the housing 102 rather than on the center dynamic system, and is given by:

$$F_{h1} \approx \pm (A - A_{eff}) \cdot P(0). \qquad \text{Eqn 10}$$

From Eqn 7 above, it may be appreciated that the effective area may be changed by controlling the shape of the function z(r) as was done with the diaphragm 128. The change in thickness profile z(r) may be gradual (shown in FIG. 2) or there may be step changes in thickness as with the surfaces 188 and 190 which are thinner in the primary flexing portions 135 and 172. The effective area of a flexure surface may thus be tailored by changing the thickness profile. In the case of the displacer, respective profiles of the first and second surfaces 188 and 190 may be different in order to achieve a desired displacer drive.

In the case of the diaphragm where the profile is varied gradually as a function of radius there is a resultant change in shape of the deflected diaphragm. A thicker center results in more of the bending at larger radius, with the result that the effective area is larger than with a uniform thickness diaphragm.

High Temperature Engine Embodiment

From Eqn 1, it should be evident that increased output power for an engine may be provided by operating with a greater differential between the hot and cold side temperatures $T_h$ and $T_c$. It is therefore desirable to operate an engine at elevated $T_h$, although this temperature may not be increased without limit due to material constraints. In the apparatus 100 shown in FIG. 2, the first surface 188 of the flexure 132 is subjected to the temperature $T_h$. For reciprocating motion at desired amplitude and operating frequencies (for example, frequencies above 250 Hz) the flexure should be designed for operating stresses below a fatigue threshold limit. Only a small number of materials exhibit infinite fatigue life, steel being the most prominent. However, maximum infinite fatigue stress decreases with increasing temperature and thus $T_h$ is severely constrained by the maximum flexure temperature. Additionally, the top wall 126 of the housing 102 operates under the load provided by the working gas pressure. The maximum operating temperature $T_h$ is thus further constrained by the materials used in the housing 102, which at high $T_h$ and under substantial load, will be less than a no load maximum use temperature.

Figure 17:
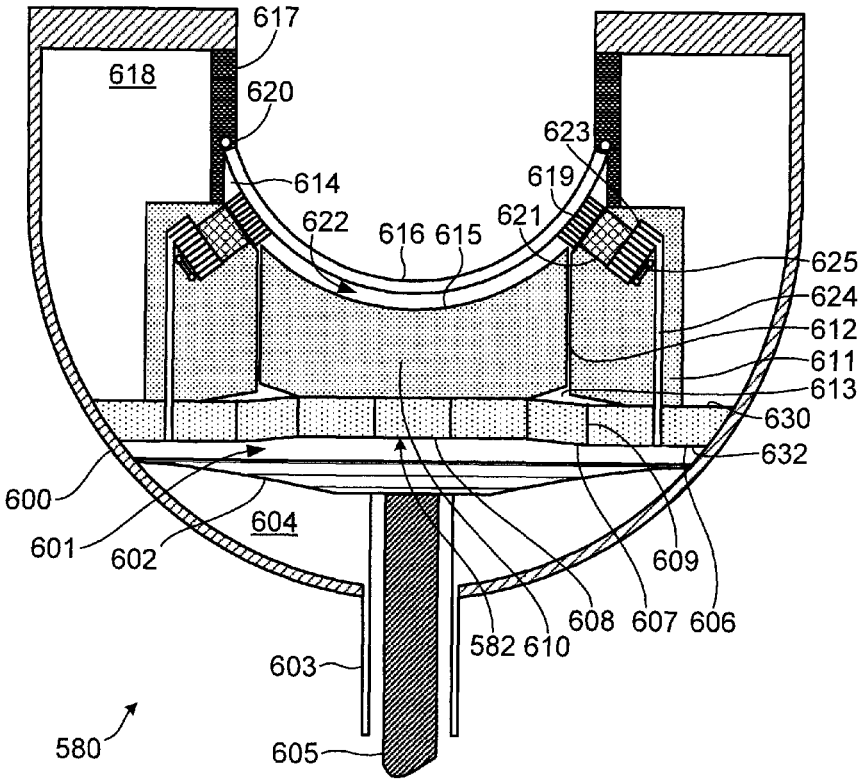
FIG. 17 is a front cross sectional schematic view of a Stirling cycle transducer apparatus according to an alternative embodiment of the invention.

Referring to FIG. 17, a schematic of a high temperature engine embodiment is shown generally at 580. The engine 580 includes a bell-shaped steel housing 600, which acts as a pressure vessel. A lower portion of the housing 600 has a generally spherical shape, which minimizes an amount of material required for construction. The engine 580 includes a compression chamber 601 and an expansion chamber 622. The engine 580 also includes a diaphragm 602, a tube spring 603, a bounce chamber 604, and a rod 605, all of which are substantially similar to the corresponding elements shown in FIG. 2 since these elements are all located on the cold side of the engine.

The engine 580 further includes a displacer 582. The displacer 582 includes first and second gas impermeable flexures 630 and 632, having a peripheral portion 606, a central portion 608, and an intermediate flexing portion 607. The peripheral portion 606 is attached to the housing 600. In this embodiment, the displacer 582 also includes supports 609, which may be annular ribs or posts for example. The displacer 582 is generally similar to the displacer 122 shown in FIG. 2, except that a height of the displacer 582 is reduced, since in this embodiment these elements no longer function as a primary insulator between the hot and cold sides of the engine 580.

The displacer 582 further includes a moving insulator 610, which is fabricated from a material capable of withstanding the maximum engine temperature $T_h$, at least at an upper surface 615. The moving insulator 610 is attached to the central portion 608 of the flexure 630 and is subjected to the same reciprocating motion as the displacer 582. The engine 580 further includes an annular insulator 611 connected to the peripheral portion 606. The annular insulator 611 may be fabricated from the same or similar material as the moving insulator 610. The moving insulator 610 moves relative to the annular insulator 611. The annular insulator 611 and moving insulator 610 together define a narrow annular gap 612, which will be hereinafter referred to as the "appendix gap". The appendix gap 612 is in communication with a volume 613 that facilitates motion of the displacer 582 without interfering with the motion of the flexures 630 and 632. The moving insulator 610 and the annular insulator 611 provide primary insulation between the hot expansion chamber 614 and the cold compression chamber 601. The walls of the insulators 610 and 611 should be gas impermeable, while an interior of the insulators may be a porous ceramic operable to provide low thermal conductivity.

The engine 580 further includes a hot wall 616 (described in greater detail below) and the top surface 615 of the moving insulator 610 has a corresponding shape that matches a shape of the hot wall. The top surface 615 of the moving insulator 610 acts as a hot side surface of the displacer 582. An area of the top surface 615 should be similar to an effective area of the cold side of the displacer 582, but may be of slightly different area to balance forces on the displacer during operation, as described earlier herein. Since the top surface 615 is a rigid surface, its effective area is the same as its physical area. For the cold side, the effective area is less than the physical area, to take into account variations in stroke of the bottom flexure with radius, as disclosed earlier herein in connection with FIG. 2.

The hot wall 616 has a dome shape to facilitate used of high conductivity ceramic materials such as Silicon Carbide (SiC) or Aluminum nitride (AlN), for example). Ceramic materials are known to be strong in compression but weak in tension. The domed shape of the hot wall 616, oriented as shown in FIG. 17, allows the forces on the hot wall due to the loading pressure of the working gas to be dominated by compression forces. Consequently, the hot wall of the engine 580 will have a maximum operating temperature $T_h$ that is considerably higher than that possible using conventional stainless steels or nickel alloys. The hot wall 616 may also be fabricated from a refractory metal such as tungsten or from a fiber composite such as carbon-carbon composite in which case, the hot wall may not necessarily be dome shaped, as these materials may also be strong in tension. Alternatively, when fabricated from a non-ceramic material the hot wall 616 may have an outwardly oriented dome shape (i.e. an opposite dome shape to the hot wall 616 depicted in FIG. 17).

In one embodiment, the external heat source for the engine 580 may be concentrated sunlight, in which case the hot wall 616 may be fabricated as a transparent fused silica or sapphire dome. Instead of conducting heat into the engine, the transparent dome would allow sunlight radiation to enter the engine and be absorbed and converted to heat inside the engine 580.

The engine 580 further includes an insulating spacer 617, extending downwardly from the housing 600. The insulating spacer 617 provides a mounting for the hot wall 616 such that compressive stresses in the hot wall are transferred to an insulating spacer. The insulating spacer 617 may be fabricated from a low thermal conductivity refractory material such as fused silica, fully stabilized zirconia ceramic or mullite ceramic. Alternatively, the insulating spacer 617 may be fabricated from Alumina ceramic, which has high temperature capability and high strength. While a room temperature thermal conductivity of Alumina ceramic is an order of magnitude larger than that of zirconia, at elevated temperature the conductivity of Alumina ceramic drops rapidly to a value similar to that of zirconia.

It is also possible to use higher conductivity materials with the thermal conduction loss kept low enough with a longer path, thinner wall or both. Alternatively, the insulating spacer 617 may be fabricated from a more advanced material having deliberately tailored properties, such as low thermally conductive versions of SiC, AlN, Silicon Nitride ($Si_3N_4$) or Sialon ceramics. In these materials, by adjusting sintering additives and a sintering profile, the thermal conductivity may be varied by an order of magnitude without significant changes to the mechanical characteristics of the material such as coefficient of thermal expansion and mechanical strength.

The insulating ring 617 transfers the load due to the working gas pressure from the hot wall 616 to the housing 600. Thus, as is the case for the dome shaped hot wall 616, the insulating spacer 617 will also be under compressive forces, which is a preferred state of loading for a ceramic material. A remaining volume 618 between the insulating spacer 617 and the housing 600 may be filled with non-load bearing porous refractory material insulation and pressurized to the working gas pressure.

The engine 580 also includes a sealing element 620 between the dome shaped hot wall 616 and the insulating spacer 617. The sealing element 620 may be a slightly compliant ring that provides a gas tight seal such that the housing 600, spacer 617, and hot wall 6161 together provide the required pressure containment. The sealing element 620 may be a high vacuum type seal, provided by indenting a softer compliant material between the harder ceramic materials of the spacer 617 and the hot wall 616. The sealing element 620 may be fabricated from a material such as a nickel-cobalt super-alloy metal.

In one embodiment, a material having high thermal conductivity is selected for the hot wall 616, while a good thermal insulator material is selected for the insulating spacer 617. The joining between two dissimilar materials may be complicated unless the materials have similar rates of thermal expansion, since dissimilar thermal expansion rates will produce large stresses at an interface between the materials as the temperature is increased to $T_h$. The ceramic materials Aluminum Nitride (for the hot wall 616) and Mullite (for the insulating spacer 617) provide a good thermal expansion match.

Alternatively, a carbon-carbon fiber hot wall 616 having fibers oriented radially, may be paired with a Zirconia insulating spacer 617. The radially oriented fibers of the hot wall 616 provide excellent radial heat conduction, while along a cross fiber axis the thermal expansion coefficient may be configured to be close to that of Zirconia. The carbon-carbon hot wall 616 having fibers oriented in the radial direction would not provide good strength in tension, and thus should have a dome shape oriented as shown in FIG. 17, where an inter-fiber matrix is predominantly in compression. A further advantage of this choice is that a hot side heat exchanger 619 may be simply fashioned by arranging for the fibers to extend past the matrix to form heat exchanger pins in the expansion chamber 614.

Alternatively, as mentioned above the thermal conductivity of ceramics may be deliberately varied without significantly affecting the thermal expansion rate. Accordingly, the hot wall 616 and the insulating spacer 617 may be advantageously manufactured from the same material. For example, the dome could be high conductivity SiC and the ring low conductivity SiC. Both dome and insulating ring then have the same coefficient of thermal expansion, which facilitates joining. A bonding layer having a composition similar to the sintering agent for the ceramic may be used to bond the high and low conductivity versions of the ceramic material.

In another alternative embodiment, the thermally conducting hot wall 616 and the insulating spacer may be fabricated from a single composite material having anisotropic thermal conduction properties, thereby avoiding the need for a high temperature seal and/or sealing element 620. For example, the domed hot wall 616 insulating spacer 617 may be manufactured as a single piece carbon-carbon composite having all the carbon fibers oriented radially. The fibers would then be oriented perpendicular to the heat flow in the spacer portion, thus providing good insulation since thermal conductivity of a carbon composite is much lower in a cross-fiber direction than in a fiber direction. The spacer 617 would thus effectively insulate the domed hot wall portion from the housing 600. In the hot wall portion the same composite material would efficiently conduct heat into the engine 580 due to the radial fiber orientation in the dome.

The engine 580 includes a hot heat exchanger 619, regenerator 621, and cold heat exchanger 623, which are generally similar to the corresponding elements shown in FIG. 10. In general, only properties of materials used for the domed hot wall 616, the insulating spacer 617, the non-load bearing insulator 618, the first heat exchanger 619, the regenerator 621, the moving insulator 610, and the annular insulator 611, limit the hot side temperature $T_h$ of the engine 580. All of these components may be fabricated from either carbon fiber or various porous and non-porous ceramics. Only the domed hot wall 616 and insulating spacer 617 have to support the full gas pressure load and in this embodiment, both elements are under compression rather than tension. It should thus be clear that with suitable material choices, the engine 580 would be able to operate at higher temperatures than comparable engines made using high temperature steel or nickel alloys.

Alternatively, for a direct heated solar powered engine 580, the hot wall 616 and insulating spacer 617 may be fabricated from a single piece of fused silica, with no high temperature joint being required. Fused silica has very low thermal conductivity and would thus provide a good insulating spacer, and in such an embodiment would not be required to conduct heat into the engine and thus a dome portion (corresponding to the domed hot wall 616) would not have to have high thermal conductivity as in other embodiments.

In the process of the displacer 582 forcing the working gas back and forth from the compression chamber 601 to the expansion chamber 622, the working gas flows through the hot heat exchanger 619, the regenerator 621, the cold heat exchanger 623, and an access tube 624. The function of these components is the same as described for the lower temperature embodiment of FIG. 2 and FIG. 10. For operation at higher $T_h$ the hot exchanger 619 and the regenerator 621 will have to withstand the higher temperature. A hot exchanger fabricated from carbon fibers will not be the temperature-limiting component since carbon fibers are capable of withstanding very high temperatures. A high temperature regenerator may be fabricated from a porous ceramic or a microcapillary array fabricated from fused silica tubing, for example.

The engine 580 also includes a heat transport conduit 625 in thermal communication with the cold heat exchanger 623 for extracting heat from the cold side of the engine. The full temperature gradient $T_h$-$T_c$ thus appears across the regenerator 621, and the regenerator material should thus be a good thermal insulator in the gas flow direction. The regenerator 621 may provide a significant parasitic heat flow path given the relatively short flow length when compared to a thermal path length through the moving insulator 610. However this short thermal path length is only over the annular area of the regenerator 621, which is only a small fraction of the total cross-sectional area separating the hot and cold sides of the engine. The thermal conductivity of a matrix of the regenerator 621 is one item to be taken into account in optimizing a frontal area of the regenerator and a flow length through the regenerator for achieving optimal performance of the engine 580.

Optimizing the component dimensions for high temperature operation will generally lead to different dimensions than at lower operating temperature. All losses and effects should be considered simultaneously to produce an overall optimum design and this may be done by building a complete thermoacoustic model of the engine. A further difference between the low temperature engine of FIG. 2 and the high temperature engine of FIG. 17 is the additional losses introduced in the appendix gap 612. There will be both viscous flow losses as gas flows in and out of the appendix gap 612 as well as heat exchange losses. Finally, there will also be shuttle losses, however, given the small displacement in the engine 580 shuttle losses will be negligible.

For the design of the appendix gap 612 there are at least three choices. In a first embodiment, the gap 612 may be sufficiently narrow at some point along its length such that a flow resistance is sufficiently large that the pressure in the volume 613 at the cold end of the appendix gap 612 does not follow pressure swings in the engine 580. In this case, thermal relaxation losses are avoided in volume 613. The flexures 630 and 632 are required to withstand a differential pressure between the compression chamber 601 and the volume 613, since the pressure in the volume 613 is substantially constant, while the pressure in the chamber 601 oscillates. Fabrication of the annular insulator 611 and moving insulator 610 to provide a sufficiently narrow appendix gap 612 requires that tight manufacturing tolerances of the elements be maintained.

In an alternative embodiment, the appendix gap 612 may be sufficiently wide that volume 613 would follow the pressure swings of the engine 580. The volume 613 would then be part of the engine working volume and thus reduce the compression for a given swept volume produced by the displacer and diaphragm. Additionally, there are thermal relaxation losses due to the pressure swing in the volume 613. There are also flow losses, since the pressure changes are a result of gas flow through the appendix gap 612. There are also heat transfer losses due to hot gas flowing towards the cold side and cold gas flowing back out to the hot side. The appendix gap 612 should be narrower than the thermal characteristic length (Eqn 3) so that the gap functions as a regenerator for the gas flow that produces the pressure swing in the volume 613. All these losses are reduced if the volume 613 has a reduced volume. Reducing a radial width of the intermediate flexing portions 607 of the flexures 630 and 632 would facilitate reduction of the volume 613, which in this case is possible since if the pressure in space 613 is substantially the same as in the compression chamber 601 the flexure need not withstand any substantial differential pressure. The dual flexures 630 and 632 may then be replaced with a single thinner and narrower flexure.

A third embodiment is generally similar to the second embodiment above, except that the remaining flexure has gas passages cut into it so that volume 613 effectively becomes part of the compression chamber 601. In this case, the pressure swings in volume 613 may be supplied predominantly by flow from the compression chamber thereby reducing the flow in the appendix gap 612. In this third case, the appendix gap 612 is a parallel regenerative gas passage for a small fraction of the working gas. Appendix gap losses depend strongly on these design choices and must be included in the thermoacoustic model of the engine in order to achieve an optimal design.

While specific embodiments of the invention have been described and illustrated, such embodiments should be considered illustrative of the invention only and not as limiting the invention as construed in accordance with the accompanying claims.

What is claimed is:

1. A Stirling cycle transducer apparatus for converting between thermal energy and mechanical energy, the apparatus comprising:

a housing;

a compression chamber disposed in the housing and having at least a first interface operable to vary a volume of the compression chamber;

an expansion chamber disposed in the housing and having a second interface operable to vary a volume of at least the expansion chamber;

a thermal regenerator in fluid communication with each of the compression chamber and the expansion chamber, the thermal regenerator being operable to alternatively receive thermal energy from gas flowing in a first direction through the regenerator and to deliver the thermal energy to gas flowing in a direction opposite to the first direction through the regenerator, the compression chamber, the expansion chamber, and the regenerator together defining a working volume for containing a pressurized working gas, each of the first and second interfaces being configured for reciprocating motion in a direction aligned with a transducer axis, the reciprocating motion being operable to cause a periodic exchange of working gas between the expansion and the compression chambers, and wherein at least one of the first and second interfaces comprises:

a resilient diaphragm; and a cylindrical tube coupled to the resilient diaphragm and connected to the housing, wherein the cylindrical tube has a cylindrical wall extending between the diaphragm and the housing, the cylindrical wall being configured to elastically deform in a direction generally aligned with the transducer axis in response to forces imparted on the cylindrical tube by the diaphragm to cause the at least one of the first and second interfaces to have a desired natural frequency, the cylindrical wall being operable to provide a seal between the diaphragm and the housing for containing the working gas.

2. The apparatus of claim 1 wherein the first interface comprises a resilient diaphragm and wherein the second interface comprises a displacer disposed between the expansion chamber and the compression chamber and wherein the reciprocating motion of the second interface is operable to vary the volume of both the expansion chamber and the compression chamber.

3. The apparatus of claim 2 wherein the expansion chamber is defined between a first surface of the displacer and a wall of the housing and the first surface of the displacer comprises a flexure configured to permit reciprocating motion of the displacer, and wherein a central portion of the wall is offset along the transducer axis from the displacer with respect to a peripheral portion of the wall for accommodating the reciprocating motion of the displacer.

4. The apparatus of claim 2 wherein the compression chamber is defined between a second surface of the displacer and the diaphragm and the second surface of the displacer comprises a flexure configured to permit reciprocating motion of the displacer, and wherein the central portion of the diaphragm is offset along the transducer axis with respect to a peripheral portion of the diaphragm for accommodating reciprocating motion of the displacer.

5. The apparatus of claim 2 wherein the displacer comprises a flexure, the flexure comprising:

a peripheral portion;

a central portion; and an intermediate flexing portion extending between the peripheral portion and the central portion, the flexing portion configured such that during reciprocating motion of the displacer, flexing occurs substantially in the intermediate flexing portion.

6. The apparatus of claim 5 wherein the peripheral portion, the intermediate flexing portion, and the central portion together define a thickness profile for the flexure, and wherein the thickness profile is selected to cause the flexure to have an effective area to cause reciprocating motion of the displacer to be out of phase with the reciprocating motion of the first interface by a desired phase angle and to have a desired amplitude, the effective area being less than a physical area of the flexure due to deformation of the flexure during reciprocating motion.

7. The apparatus of claim 6 wherein the thickness profile of the flexure is selected to cause the flexure to have an effective area to impart reciprocating motion to the displacer at the desired phase angle in absence of reciprocating complementary vibration of the apparatus.

8. The apparatus of claim 5 wherein the flexure comprises a first flexure operable to vary a volume of the expansion chamber and wherein the displacer further comprises a second flexure operable to vary a volume of the compression chamber, the first and second flexures being spaced apart and configured for corresponding reciprocating motion and wherein the second flexure comprises:

a peripheral portion;

a central portion; and an intermediate flexing portion extending between the peripheral portion and the central portion, the intermediate flexing portion being configured such that during reciprocating motion, flexing occurs substantially in the intermediate flexing portion.

9. The apparatus of claim 8 further comprising an insulating material disposed between the first and second flexures, the insulating material being operable to provide thermal insulation between the expansion chamber and the compression chamber.

10. The apparatus of claim 8 wherein the first and second flexures define an insulating volume therebetween, the insulating volume being operable to receive an insulating gas having a lower thermal conductivity than the working gas.

11. The apparatus of claim 8 wherein the peripheral portion, the intermediate flexing portion, and the central portion together define a thickness profile for the respective first and second flexures, and wherein the thickness profile of at least one of the first and second flexures is selected to cause the flexure to have an effective area to cause reciprocating motion of the displacer to be out of phase with the reciprocating motion of the first interface by a desired phase angle, the effective area being less than a physical area of the first and second flexures due to deformation of the flexures during reciprocating motion.

12. The apparatus of claim 8 further comprising a support extending between the first flexure and the second flexure, the support being operable to couple the first and second flexures.

13. The apparatus of claim 12 wherein the support is disposed in at least one of:

the central portion of the respective first and second flexures; and the intermediate flexing portion of the respective first and second flexures.

14. The apparatus of claim 1 wherein at least a portion of the cylindrical wall of the cylindrical tube is disposed to contain the pressurized working gas.

15. The apparatus of claim 1 wherein cylindrical wall of the cylindrical tube comprises:

an outer cylindrical wall having first and second ends, the first end being coupled to the housing; and an inner cylindrical wall coaxially disposed within the outer cylindrical wall and coupled between the second end of the outer cylindrical wall and the diaphragm.

16. The apparatus of claim 1 wherein the working gas bears on a first surface of the diaphragm and wherein the cylindrical wall of the cylindrical tube is coupled between a second surface of the diaphragm and the housing to define a bounce chamber between the second surface of the diaphragm, the housing, and the cylindrical wall, the bounce chamber being operable to contain a gas volume bearing on the second surface of the diaphragm.

17. The apparatus of claim 1 wherein the cylindrical tube comprises a bore and further comprising a rod mechanically coupled to the diaphragm and extending outwardly within the bore of the cylindrical tube, the rod being operable to facilitate coupling of the transducer to an electro-mechanical transducer.

18. The apparatus of claim 1 further comprising a strain gauge disposed on the cylindrical wall of the cylindrical tube, the strain gauge being operably configured to produce a time varying strain signal representing an instantaneous strain in the cylindrical wall during reciprocating motion, the time-varying strain being proportional to an amplitude of the reciprocating motion of the diaphragm and an average value of the time varying strain signal being further proportional to an average static working gas pressure.

19. The apparatus of claim 1 wherein the diaphragm comprises a material capable in operation of infinite fatigue life and wherein the diaphragm has a thickness profile across the diaphragm that is selected to cause stress concentrations across the diaphragm to be reduced below a fatigue threshold limit for the material.

20. The apparatus of claim 1 wherein the working gas bears on a first surface of the diaphragm and further comprising a bounce chamber for containing a pressurized gas volume bearing on a second surface of the diaphragm and wherein a volume of the bounce chamber is selected to be sufficiently larger than a swept volume swept by the diaphragm during the reciprocating motion such that pressure oscillations in the bounce chamber are reduced thereby reducing hysteresis losses associated with the gas volume in the bounce chamber and further comprising an equalization conduit for facilitating gaseous communication between the working gas in the expansion and compression chambers and the gas volume in the bounce chamber, the equalization conduit being sized to permit static pressure equalization between the working gas and the gas volume within the bounce chamber while being sufficiently narrow to prevent significant gaseous communication during time periods corresponding to an operating frequency of the transducer apparatus.

21. The apparatus of claim 1 wherein the expansion chamber is configured to receive thermal energy from an external source for increasing a temperature of the working gas within the expansion chamber and wherein:

the reciprocating motion of at least one of the first and second interfaces alternately causes:

the increased temperature working gas in the expansion chamber to pass through the regenerator, thereby reducing a temperature of the working gas flowing into the compression chamber;

the reduced temperature working gas in the compression chamber to pass through the regenerator, thereby increasing a temperature of the working gas flowing into the expansion chamber;

the reciprocating motion of at least one of the first and second interfaces facilitating expansion of the working gas when an average temperature of the working gas is increased and compression of the working gas when the average temperature of the working gas is reduced; and wherein at least one of the first and second interfaces comprise an electro-mechanical transducer coupled to the interface, the electro-mechanical transducer being operably configured to receive mechanical energy from the interface and to convert the mechanical energy into electrical energy.

22. The apparatus of claim 1 wherein at least one of the first and second interfaces comprise an electro-mechanical transducer coupled to the interface for imparting the reciprocating motion to the interface and wherein:

the reciprocating motion of at least one of the first and second interfaces alternately causes:

the working gas in the compression chamber to pass through the regenerator, thereby reducing a temperature of the working gas flowing into the expansion chamber;

the working gas in the expansion chamber to pass through the regenerator, thereby increasing a temperature of the working gas flowing into the compression chamber; and the reciprocating motion of at least one of the first and second interfaces facilitating compression of the working gas when an average temperature of the working gas is increased and expansion of the working gas when the average temperature of the working gas is reduced thereby causing the expansion chamber to be cooled relative to the compression chamber.

23. The apparatus of claim 1 further comprising:

a first heat exchanger in communication with the expansion chamber;

a second heat exchanger in communication with the compression chamber, the thermal regenerator being disposed between the first and second heat exchangers; and wherein each of the first and second heat exchangers are peripherally disposed within the housing with respect to the transducer axis and configured to receive working gas flowing to or from the respective chambers and to redirect the working gas flow through the regenerator.

24. The apparatus of claim 23 wherein each of the first and second heat exchangers have a greater transverse extent than height and are configured to cause gaseous flow in a generally transverse direction through the heat exchangers.

25. The apparatus of claim 24 wherein each of the first and second heat exchangers comprise a substantially transversely extending interface in communication with the regenerator and wherein redirection of the working gas flow occurs proximate the interface.

26. The apparatus of claim 23 further comprising a heat transport conduit disposed in thermal communication with at least one of the first and second heat exchangers, the heat transport conduit being configured to carry a heat exchange fluid for transporting heat between an external environment and the at least one of the first and second heat exchangers.

27. The apparatus of claim 23 wherein the expansion chamber is separated from the compression chamber by an insulating wall dimensioned to provide sufficient thermal insulation to reduce heat conduction between the expansion chamber and the compression chamber, and further comprising at least one access conduit for directing working gas between at least one of:

the expansion chamber and the first heat exchanger; or the compression chamber and the second heat exchanger.

28. The apparatus of claim 1 wherein the transducer apparatus is used for converting between thermal energy and mechanical energy and wherein the expansion chamber comprises an expansion chamber wall, the expansion chamber wall comprising:

a high thermal conductivity wall; and a low thermal conductivity insulating spacer extending between the wall and the housing.

29. The apparatus of claim 28 wherein the high thermal conductivity wall comprises a first silicon carbide material composition having a high thermal conductivity and wherein the low thermal conductivity insulating spacer comprises a second silicon carbide material composition having a low thermal conductivity.

30. The apparatus of claim 28 wherein the high thermal conductivity wall comprises a material that has greater strength in compression than in tension and wherein the wall is fabricated in a dome-shape such that in operation the wall is primarily subjected to compressive stresses.

* * * * *